United States Patent [19]

Milton, Jr.

[11] 4,094,627

[45] June 13, 1978

[54] OVEN SYSTEM

[76] Inventor: Clare L. Milton, Jr., 9325 Snowden River Pkwy., Columbia, Md. 21046

[21] Appl. No.: 613,641

[22] Filed: Sep. 15, 1975

Related U.S. Application Data

[63] Continuation of Ser. No. 521,525, Nov. 6, 1974, abandoned, and a continuation-in-part of Ser. No. 464,185, Apr. 25, 1974, abandoned.

[51] Int. Cl.[2] ..... F27B 9/28; F23J 15/00

[52] U.S. Cl. ..... 432/59; 34/242; 432/72; 432/152; 432/242

[58] Field of Search ..... 432/59, 72, 152, 180, 432/242; 34/242

[56] References Cited

U.S. PATENT DOCUMENTS

| | | | |
|---|---|---|---|
| 3,472,498 | 10/1969 | Price et al. | 432/72 |
| 3,524,632 | 8/1970 | Davies | 432/72 |
| 3,744,963 | 7/1973 | Flynn | 432/59 |
| 3,787,171 | 1/1974 | Cromp | 432/59 |
| 3,851,402 | 12/1974 | Turnbull et al. | 34/242 |
| 3,874,091 | 4/1975 | Fukumoto | 432/59 |

*Primary Examiner*—John J. Camby

*Attorney, Agent, or Firm*—Leydig, Voit, Osann, Mayer & Holt, Ltd.

[57] ABSTRACT

An oven system useful for baking coatings on steel sheet and the like is disclosed. The system includes an oven through which material to be heated is conveyed. A hot air supply system provides substantially all of the heat requirements of the oven and air from the oven is passed into a fuel fired incinerator wherein incineration and heating of the air and combustion of any solvent present is effected. A regenerative heat interchange means such as a pebble bed regenerator is interposed between the exit of the incinerator and the hot air supply system and serves to effect of heating of the fresh air to provide at least a portion of the hot air for the hot air supply system using the heat content of the incinerated air from said incinerator.

28 Claims, 12 Drawing Figures

Fig. 1.
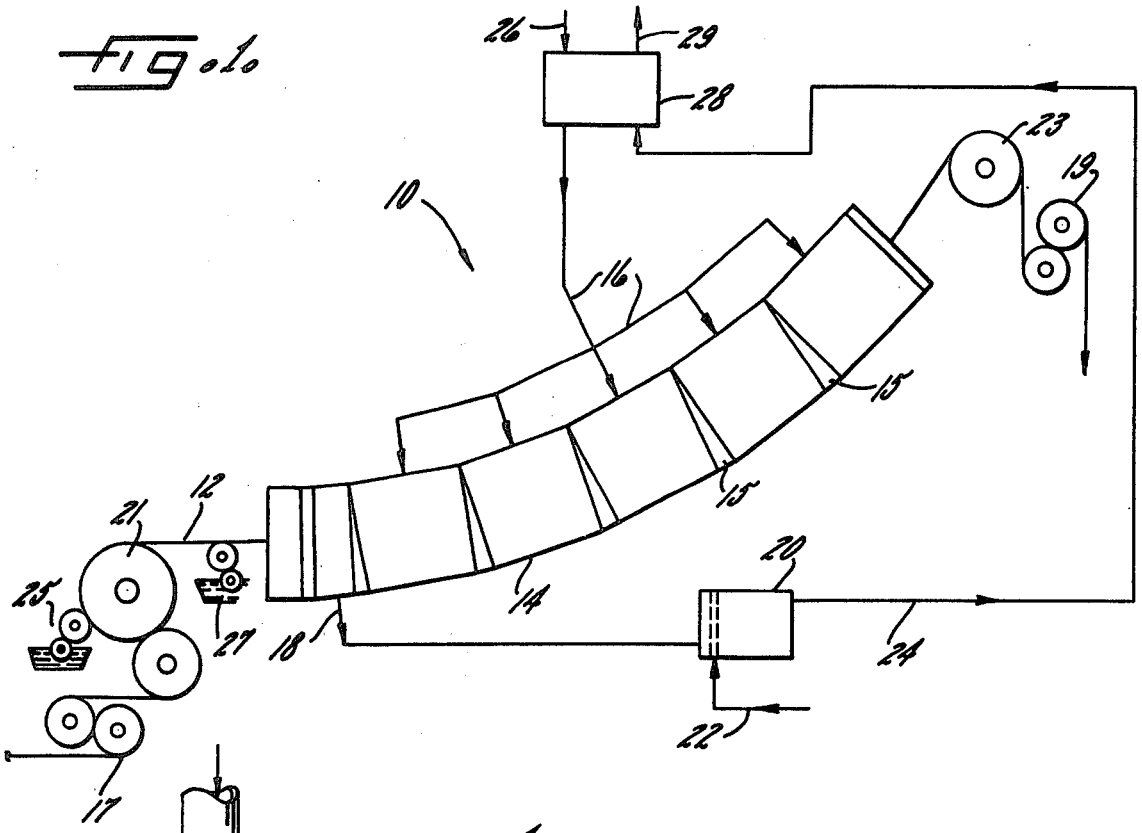
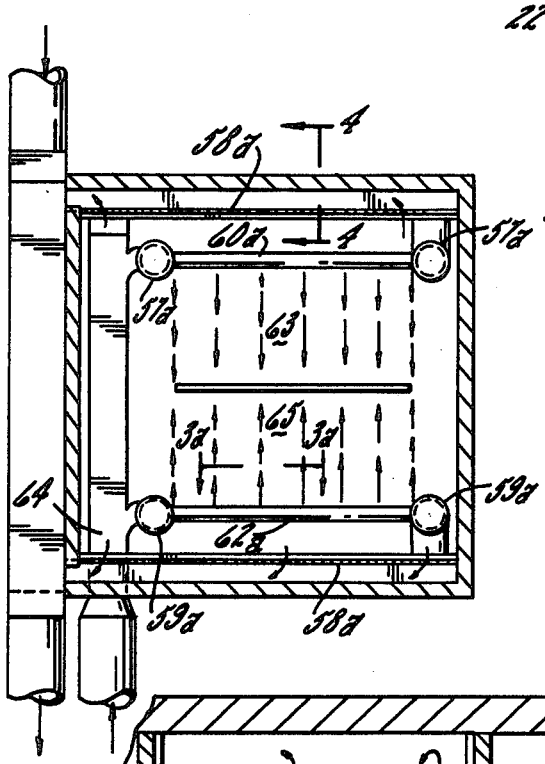
Fig. 3.
Fig. 3a.
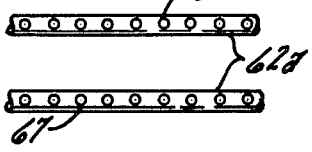
Fig. 4.
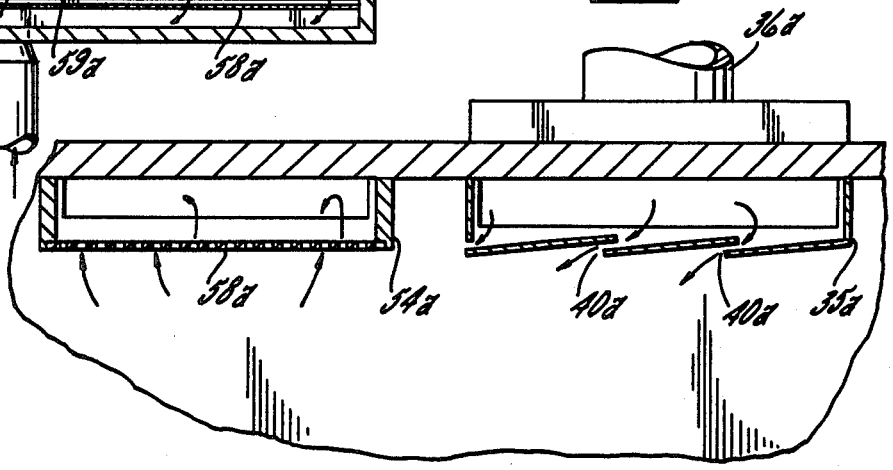

TERMINAL
HEAT-UP #2
HEAT-UP #1
T.C.
P.C.
FROM FIG. 2a.

6
80
74
70
90
86
32
98
100
92
88
76
72
102
80
82
T.C.
104
96
94
78

186
184
V
180
182
FROM P.T.C. 168
H/S
172
170
50
164
MFC
F/C
TO INCINERATOR FUEL CONTROL
112
48

TO EVAP. ZONE #2 AIR SUPPLY
TO EXHAUST FLOW SUB LOOP
168
P.T.C.
TO REGENERATOR

FROM EXHAUST VESTIBULE
120
130
166
126
V
124
118
H/S
T.C.
117
122
R/R
167
128
GAS
FROM MFC

OVEN SYSTEM

This application is a continuation of Ser. No. 521,525 filed Nov. 6, 1974, now abandoned; and a continuation in part of Ser. No. 464,185, filed Apr. 25, 1974, now abandoned.

The present invention relates to oven systems and, more particularly, to large scale industrial oven systems wherein the conservation of energy is vitally important.

For example the primer and finish coat ovens for the painting of steel sheet such as are used in the coil coating industry are recognized as requiring enormous quantities of heat and not being very efficient in the utilization thereof. The processing of conventional steel coil (e.g. 48 inches wide, 0.020 inch thick) at about 400 feet per minute frequently requires that the metal temperature attain values of about 400° F. and about 450° F. in the primer and finish coat ovens, respectively. In turn, assuming that sheet enters the ovens at about ambient temperature, the heat absorbed by the steel is of the order of 3 million BTU/hour in the primer oven and 3.5 million BTU hour in the finish coat oven. Since the solvents used in priming and painting frequently have a heat of combustion about equal to the heat absorbed by the sheets, by utilizing this heat of combustion it should be possible to provide a system in which additional fuel requirements are low.

In practice, however, such has not been achieved for a number of reasons. An approach to the design of an efficient oven system can involve continuously evaporating solvent, incinerating the solvent laden air, and recirculating the incinerated air to provide oven heat for evaporation and baking. One problem is that complete recirculation leads to the buildup of intolerable concentrations of carbon dioxide and water vapor. Furthermore, complete recirculation is not possible since fresh air must be introduced to maintain an adequate oxygen index for incineration, and for curing many types of enamels as well.

Recognizing, from the foregoing, that an oven system requires the introduction of fresh air, and, in turn, the discharge to the atmosphere of an equivalent volume of incinerated air, the problem is to efficiently transfer the heat of the hot incinerated air to the fresh air and thereby permit the introduction of fresh air without the loss of heat. However, even assuming that efficient heat transfer can be effected, the problem still remains to avoid the introduction, by leakage, of additional and unwanted cold air into the system. Since no air can accumulate in the oven system and any air which leaves the system must be substantially completely incinerated to reduce the level of contaminants to avoid atmospheric pollution, cold air leaking into the system represents potentially large system heat losses. For example, in an oven system employing incineration at about 1300° F., every thousand cubic feet per minute of ambient air which leaks, is drawn or blown into the system results in the heat removal from the system of about 1.4 million BTU/hour even assuming that the system is completely efficient in other respects.

In further considering this aspect, it should be appreciated that the ovens used for priming and baking are necessarily large in order to permit economic operation. The ovens are frequently more than 100 feet long, in excess of 5 feet wide, and 10 feet or more high. In order to accommodate variations in sheet configuration such as twisting and the like, the openings at the ends of the ovens are often quite large, e.g., about 5 feet by 3 or 4 feet. The difficulty in controlling leakage of fresh air into the ends of the ovens, or the loss of hot air has created the need for an improved highly heat efficient system.

Accordingly, it is a principal object of the present invention to provide an oven system which is highly efficient in the utilization of energy. Closely related is the objective of providing such a system wherein the discharge of hot air to the atmosphere is greatly minimized.

A further object is in providing an oven heating system wherein hot fresh air is provided for oven heating and ventilation and substantially contaminant free air is exhausted from the system at a low temperature.

A further object resides in providing an oven system wherein the fuel value of solvent evaporated both in the system and its associated environment is utilized efficiently to provide heat for the system.

In connection with the foregoing object, a further objective resides in providing an oven wherein solvent laden air exhausted therefrom is incinerated and the heat value thereof efficiently recovered before discharge to the atmosphere. And, in this respect, a more specific object resides in accomplishing oven heating and maintenance of an adequate oxygen index for baking and incineration by introducing into the oven fresh air which has been heated by regenerative interchange with air issuing from the incinerator.

Still a further object of the invention is to minimize the fuel required for the incineration of oven exhaust while assuring substantially complete incineration of contaminants. And in this respect, a more particular object is to efficiently utilize, for incinerator heat, the heat of combustion of evaporated solvents.

Yet an additional object is to provide an oven design wherein heat is provided by introduction of hot fresh air and the introduction of cold air is kept to a controlled minimum. In this respect, a particular object resides in minimizing the introduction of cold air into an oven when not necessary for solvent dilution to thereby limit the consumption of fuel to a value closely approximating radiative and convective oven system losses and sensible heat transferred to the work.

A related objective of the present invention resides in minimizing the need for introduction of cold fresh air to an oven to maintain solvent concentrations at a safe level by effectively utilizing for solvent dilution the air introduced for supplying the oven heat demands.

In more specific respects, related objects reside in providing means for measuring and controlling in-leakage of cold air into the oven. And, in particular, a further object is to independently control in-leakage at the ends of the ovens.

A further objective is to provide a method of operation of an oven system which affords a known minimum margin of safety with respect to the hazard of explosion and in which this minimum margin of safety is independent of the operating temperature in the oven.

An object of this invention also resides in providing means for uniformly and efficiently heating work within an oven so as to maximize the convection heat transfer coefficient and thereby permit reduction of oven length and temperature. Related thereto is the further object of providing quick and efficient means for changing the rate of heat transfer to the work being heated independent of the temperature of the heating oven or the speed of the work. An additional related object is to provide an oven system wherein high heat transfer can be effected and which can also accommodate and effectively heat badly twisted sheet material without scratching.

Other objects of the present invention are to provide, in an oven system which includes a plurality of ovens, reduced installed total incinerator volume and exhaust blower capacity and horse power, and to minimize the ratio of high to low flows through any individual flame contact incinerator burner. A further object resides in utilizing most effectively the heat of combustion of solvents in the exhaust streams of a plurality of ovens when the concentrations of solvents in the streams differ widely.

Other objects and advantages of the present invention will become apparent by reference to the following description and the accompanying drawings in which:

FIG. 1 is a schematic block diagram, in elevation, of an oven system embodying aspects of the present invention;

FIGS. 2(a) and (b) are side elevation views, partially in section, of an oven such as schematically illustrated in FIG. 1, but generally horizontal for illustrative purposes.

FIG. 3 is a sectional view showing the interior of the first evaporation zone illustrated in FIG. 2(a) taken along line 3—3 thereof;

FIG. 3*a* is a fragmentary view illustrating a portion of a ladder member taken along line 3*a*—3*a* of FIG. 3.

FIG. 4 is an enlarged sectional view taken along line 4—4 of FIG. 3.

Figure 2A:
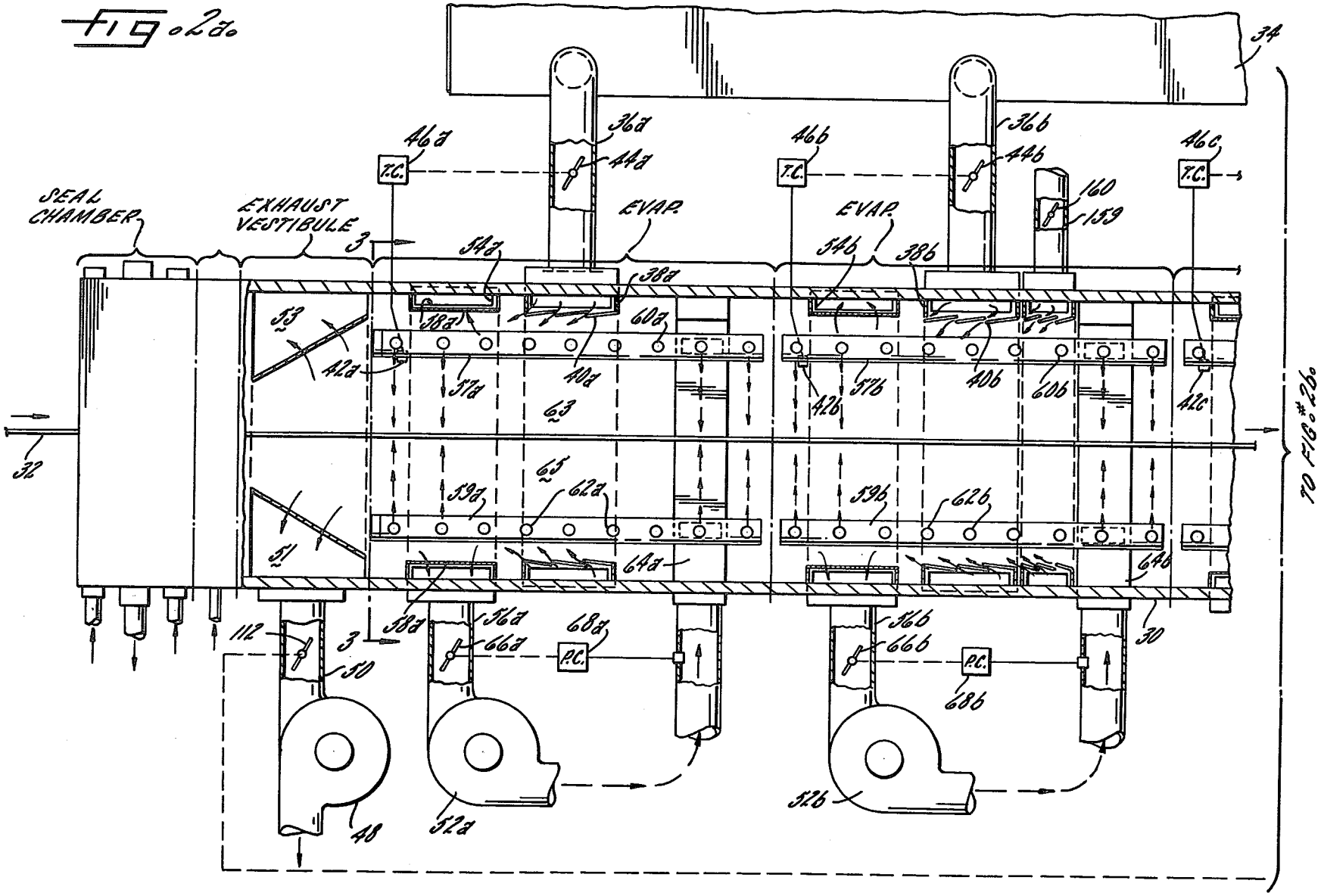

While the invention will be described in connection with certain preferred embodiments and procedures, it is to be understood that the invention is not to be limited to those embodiments and procedures. On the contrary, all alternatives, modifications, and equivalents as can be included within the scope and spirit of the invention defined in the appended claims are intended to be covered.

THE GENERAL OVEN SYSTEM

Turning to FIG. 1, which has been intentionally made very diagrammatic to facilitate understanding of the present invention, an oven system 10 for the continuous thermal treatment of material is illustrated. Therein a metal sheet 12 is heated as it passes longitudinally through the oven 14 which, in turn, is heated throughout its length by the introduction of hot air 16 at various locations therein. As hereinafter described, the oven 14 is functionally divided into various zones and vestibules which can be prefabricated as generally rectangular sections and, as illustrated in FIG. 1, thereafter assembled using conventional expansion joint means 15.

Movement of the sheet 12 through the oven 14 is effected, under tension, by means of a sheet conveying mechanism which includes the coordinated drive bridle arrangements 17 and 19 and input and output sheet supporting elements located at opposite ends of the oven, in the form of the rolls 21 and 23. Coating of the sheet, on both sides, prior to passage through the oven is accomplished at the illustrated coating stations 25, 27.

As is illustrated in FIG. 1, the sheet adopts the shape of a catenary in the span between the supporting rolls 21 and 23 with the output roll 23 being elevated with respect to the input roll 21. In turn, the lowest point of the catenary which the sheet adopts is disposed toward the front end of the oven and the angle of inclination, to the horizontal, of the sheet material in the vicinity of the input supporting roll 21 is reduced.

The illustrated arrangement of supporting elements is particularly useful in facilitating the processing of cambered sheet material, i.e., material, one of whose edges is longer than the other, which necessitates the use of low conveying tensions in order to minimize twisting while within the oven. With the illustrated arrangement, low tensions can be used, and yet the coating stations can be positioned in close proximity to the floor, a feature which is desirable from both a maintenance and capital cost standpoint.

Referring still to FIG. 1, movement of air within the oven countercurrent to the direction of sheet travel is effected in part by continuously removing exhaust air 18 from the oven near the entry end thereof and, as shown, the exhaust air 18 is then incinerated in the incinerator 20 provided with independent fuel supply means 22. The heat value of the hot incinerated air 24 is then transferred to the incoming cold fresh air 26 in the heat exchanging means 28 thus providing the hot fresh air 16 for oven heat with the cooled incinerated air 29 being discharged to the atmosphere at substantially ambient temperature.

It can be appreciated that the overall oven system 10 is highly efficient in utilization of energy. The only fuel requirement is that for the incinerator 20. This can be quite small when appreciable quantities of solvent are being released in the oven, and, therefore, are available as fuel in the incinerator.

The optimum efficiency, however, of the illustrated system depends on a number of factors. These include, for example, the avoidance of introduction of unnecessary cold air into the oven such as at the ends thereof or for solvent dilution, and the efficient transfer of heat in the exchange means. Avoidance of the introduction of cold air is most important when there is little or no flow of solvent into the system and the entire heat demand must be supplied by fuel.

OVEN HEATING SYSTEM

Turning to FIGS. 2*a* and *b* (hereinafter collectively referred to as FIG. 2 unless the context otherwise admits), a generally horizontally extending oven 30, supported by means not shown, for continuously baking a metal sheet 32 is shown for the purpose of illustration. As discussed above, however, the sheet desirably assumes the shape of a catenary within the oven and it is to be understood therefore, that the oven, in practice, conforms generally to this shape. Continuous movement of the sheet through the oven 30 is effected by conventional coordinated drive bridle means, as above discussed and, prior to entering the oven, a coating, usually dissolved or dispersed in an organic solvent, is applied to one or both sides of the sheet.

The depicted oven 30 comprises an elongated open-ended housing containing a principal sheet material heating area, defining pairs of evaporation zones and heat-up zones and a terminal zone. As the sheet passes through the oven, evaporation of solvents and the like in the coating is first effected in the depicted evaporation zones, principal heat transfer to the sheet then occurs in the heat-up zones with curing of the coating and/or additional heating being effected in the illustrated terminal zone. Conventional cooling means, not illustrated, such as a water quench are provided for cooling the sheet after it leaves the oven.

Figure 2B:
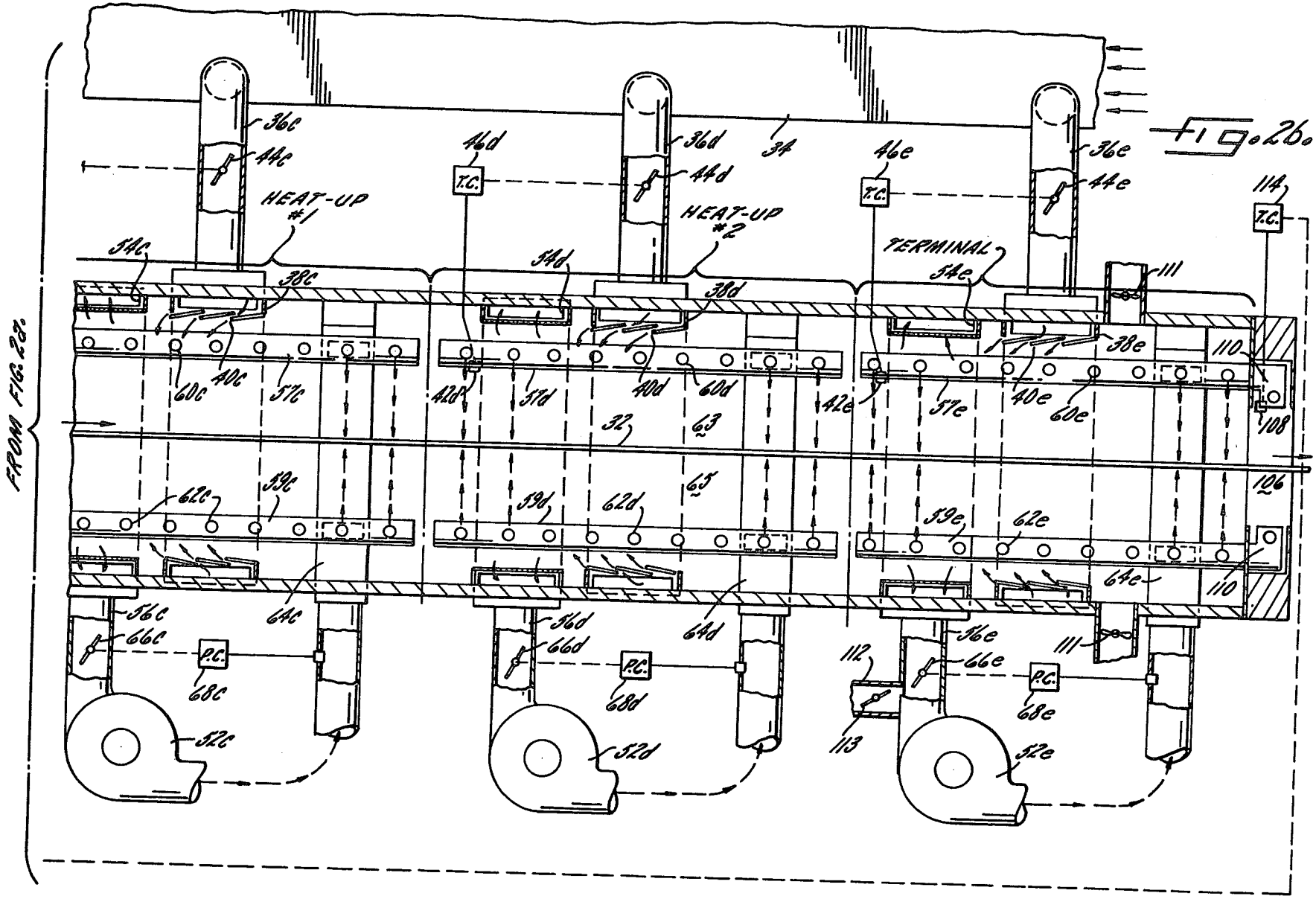

For supplying heat to the oven a low pressure hot air source defined, in part, by the main supply manifold 34 is provided. As shown in FIGS. 2 and 3, the manifold 34 is coupled to the zones of the oven 30 by supply ducts 36*a*–36*e*, each of which opens into and supplies a pair of zone inlet ducts 38*a*–38*e* which extend laterally across the oven and are parallely disposed adjacent the top and bottom oven surfaces. Hot air for the oven is supplied through the zone inlet ducts from the main supply manifold 34 and enters the oven through, as particularly illustrated in FIG. 4, the slots 40*a*–40*e* provided in the bottoms of the inlet ducts 38*a*–38*e*.

Referring again to FIG. 2, temperature in the oven zones is sensed by thermocouples 42*a*–42*e* located within the oven adjacent the entry end of each zone. In turn, temperature control in a zone is effected by regulating the volume of the hot air introduced through the supply ducts 36*a*–36*e*. To this end, each of these supply ducts has located therein an adjustable damper 44*a*–44*e* which regulates the flow of hot air into and in turn the temperature in the oven zone. In conventional fashion, and as illustrated in FIG. 2, the temperature in a zone is controlled by individually feeding the output from conventional transmitters, not shown, associated with each of the thermocouples 42*a*–42*e* to respective temperature controllers 46*a*–46*e*, the outputs from which independently regulate the positions of the dampers 44*a*–44*e* in the respective supply ducts 36*a*–36*e* to maintain zone temperatures constant at the values of predetermined set points. Suitable controllers are, for example, those supplied by the Leeds & Northrup Co. under the trademark "Electromax III".

In operation, the set points of the temperature controllers are predetermined to effect appropriate solvent evaporation and sheet heating based on previously known parameters such as the thickness of the sheet being treated, its speed, the coating used and the like. Providing for automatic zone temperature control insures that proper operating conditions will be maintained when, for example, the temperature or pressure of the hot low pressure supply air changes.

In further considering zone temperature control and particularly with respect to ovens used for metal strip painting, the continuous operation is attended by more- or less frequent interruption from accidental mechanical causes such as the tearing of a joint between the end of one coil and the start of another. When such an interruption occurs, the motion of the line stops, leaving the paint on the sheet exposed to temperatures which it cannot long withstand without decomposing and flaking off. When this occurs in a typical catenary oven, a time-consuming cleaning operation must be undertaken.

Therefore, in accordance with a preferred aspect of this invention, the zone temperature controllers 46*a*–46*e* are cascade controllers, or "computer set supervisory" controllers in which the set-point can be locally set at the controller station, or be determined by a signal from some remote source, and selection between the two is accomplished by a relay or electronic gate. A signal chosen to correspond to the highest temperature which the paint system can tolerate for a period of, for example, 15 minutes is established. This signal is fed as a cascade set-point for each zone controller when an emergency condition is determined to exist while normally the controller operates at its locally established set point. This emergency condition may be initiated manually or automatically. When it is initiated, all zone set-points are shifted to their emergency values. The result is a sudden cooling of the entire oven to a temperature low enough to prevent charring of the paint, but high enough that normal operating conditions can be reestablished relatively quickly when the emergency condition has ceased to exist. For the purposes of the present invention, oven operation during such emergency conditions will be referred to as the "emergency mode" to distinguish such from normal operation which will be referred to as the "run mode" and from a hereinafter described "idling mode".

Moreover, during periods of extended operation at relatively low temperature during emergency mode operation, it is possible for organic material to condense on oven surfaces and to polymerize into a gummy residue. In accordance with a further aspect of this invention, this residue can be removed without laborious hand operations by simply raising the locally determined controller set-point to a temperature at which organic material will oxidize completely within a period of some hours and operating the oven at this temperature. Operation at a temperature of 900° F. for less than four hours or at 850° F. for slightly extended periods of time generally accomplishes removal of organic residues without requiring mechanical assistance.

THE OVEN EXHAUST SYSTEM

Still referring to FIG. 2, a counter current, cascading air sweeping system is provided for continuously exhausting air from the oven. To this end exhaust air is drawn from the oven by means of the fan 48 through the exhaust duct 50 which communicates with the top and bottom exhaust plenums 51, 53 in the exhaust vestibule. As illustrated, the exhaust vestibule is located near the front of the oven just before the first evaporation zone, and in operation, therefore, the exhaust system effects cascading of sweep air through the entire length of the oven countercurrent to sheet travel. This is an important feature of the present invention. Since at certain times large quantites of air must be swept through the evaporation zones to remove solvents and the like and maintain sufficiently low solvent concentrations in these zones so as to minimize explosive hazards, air in addition to that simply required for maintaining temperature is frequently needed. Exhausting all of the air from the entry end of the oven achieves the result that a volume of air equal to all of the hot air introduced into the oven for heating purposes is available as sweep air for the evaporation zones. This minimizes the necessity for introducing cold fresh air into the system and the attendant necessity for discharging an equivalent amount of hot air with its accompanying heat loss.

Moreover, as a practical matter, for any metal gauge and speed, coating material and thickness, there is a limit to the temperature to which the evaporation zone can be raised without encountering blistering or other film defects. Thus, simply increasing the flow of hot air to the evaporation zones to provide necessary sweeping is not enough. However, with the presently illustrated system, simultaneous control of temperature and provision of necessary sweep air volume can be effected. By the time the hot air introduced into the heat-up zones reaches the evaporation zones it has cooled to an appropriate temperature for these zones and constitutes sweep air for the system.

Further in keeping with this aspect of the present invention, the illustrated countercurrent exhaust system, in which all of the exhaust is taken off at a single point at the entry end of the oven, minimizes the safety hazards which exist in ovens whose exhausts are withdrawn from several points. Since, in the illustrated cascade system, the total exhaust volume flows through the entire length of the portion of the oven in which solvent is evaporated, it is consequently immaterial where along this portion the solvent is evolved. This is not the case with multiple exhaust ovens which depend for maintenance of safe solvent concentrations upon close correspondence between the fractions of solvent evaporated in and the fractions of exhaust withdrawn from the several zones.

EFFECTING HIGH HEAT TRANSFER TO THE SHEET

In accordance with a further important feature of the present invention, a heating system is provided for effecting convective heat transfer to the sheet in a manner which achieves a high convection coefficient by jet impingement while still permitting longitudinal flow of heating air. To this end, the oven 30 is provided with apertured hot air delivery headers, disposed on either side of the sheet material and substantially coextensive with the width thereof, for effecting impingement of hot air, as jet streams, onto the sheet surfaces in a substantially perdendicular direction and at a high velocity. To achieve substantially perpendicular impingement, unaffected by the generally longitudinal flow of heating air, the headers are positioned at an intermediate elevation within the oven so as to thereby separate the oven into convection working regions adjacent the surfaces of the sheet material and longitudinal air flow regions located between the delivery headers and the top and bottom of the oven.

In the embodiment illustrated in FIGS. 2, the delivery headers are in the form of individual hollow ladders, having side pieces 57*a–e* and 59*a–e* for delivering air to the rungs 60*a–*60*e* and 62*a–*62*e*, the ladders are located in, and extend substantially the length of, each zone with the convection working regions above and below the sheet being designated as 63 and 65, respectively. For delivering high pressure hot air into the working regions and onto the sheet surfaces, as high velocity jets of air, the rungs of the ladders extend laterally across the zones to a width somewhat wider than the sheet being processed and contain, as shown in FIG. 3*a*, small apertures 67 in their sheet facing surfaces.

In order to supply air to the delivery headers, an air recirculation system for each zone is provided. Thus, with reference to FIG. 2, withdrawal of hot air from a zone is effected by blowers 52*a–*52*e* through the pairs of exhaust plenums 54*a–*54*e* located in each zone, which plenums extend laterally across the oven zones and are located adjacent the top and bottom of the oven. Each pair of plenums is coupled to its respective blower on the suction side by ducts 56*e–*56*e* and, in order to equalize pressure drop and assure uniform hot air withdrawal across the plenum length, the inlet surfaces thereof comprise, as illustrated in FIGS. 3–4, a perforated plate such as 58*a*. Hot air withdrawn from the zones through the ducts 56*a–*56*e* is, in turn, conveyed back into the zones through the ladder inlet ducts 64*a–*64*e*, each of which opens into the longitudinally extending sidepieces of both ladders contained in each zone.

The coefficient of convection heat transfer is moderately sensitive to changes in the velocity of vertically impinging air in the working regions. Therefore, the illustrated jet impingement system provides, in addition to effective sheet heating, a quick and convenient means for compensating for changes in metal sheet gauge or the curing potential of the coating materials without necessitating changes in line speed or oven temperature. To this end, the ducts 56*a–*56*e* have positioned therein adjustable dampers 66*a–*66*e* operated by pressure controllers 68*a–*68*e*. Simply by damper adjustment, air impingement velocity can be changed and, in turn, the coefficient of convection heat transfer rapidly modified so as to effect appropriate heating.

When jets of heating air are relatively long, e.g. length-to-jet diameter in excess of about 8 (as they must be in a catenary oven which provides space within which sheet of poor shape may twist without scraping), they are very susceptible to being deflected by currents of air flowing more or less at right angles to the axes of the jets. The resulting reduction of the heat transfer coefficient due to such "crossflow" can easily reach 70%. In order to prevent the low pressure heating air introduced into the oven through the ducts 38*a–*38*e* and from adjacent zones from adversely affecting the convection heat transfer in this manner, the ducts are, as illustrated in FIGS. 2 and 3 disposed well above and below the working regions with the duct slots 40 being inclined in the direction opposite to that of sheet movement. This arrangement causes the low pressure high temperature air to enter the zones with a momentum in a longitudinal directional so that the desirable countercurrent air flow occurs outside of the working region defined by the ladders and sheet material. Additional longitudinal momentum can be provided by means of perforations in some of the ladder rungs of the jet impingement system so that small streams issue in a direction slightly away from the sheet and largely horizontal. Thus, the longitudinal flow of air within the oven does not interfere with the vertical impingement of high velocity hot air and, in turn, desirable high coefficients of convection heat transfer are obtained.

Apart from the difficulties in maintaining substantially vertical impingement, the use of long air jet streams presents difficulties in achieving uniformity of heating in the lateral direction across the width of the sheet. Non-uniform heating can result when the withdrawal of air from the oven zone is not uniform per unit of width across the sheet. To achieve uniform lateral heating, not only must the pressure drop through the apertures of the header be several times the pressure drop from one end of the header to the other, but the delivery headers are preferably an open array of elements such as the illustrated ladders, wherein the open area between the air supply headers is at least about 60% of the protected area of the array. Using such, a vertical rather than lateral air return path is provided.

Furthermore, non-uniform sheet heating results when, even though uniform vertical impingement onto the sheet and return is effected, the withdrawal of recirculation air from above and below the sheet in each zone does not proportionally correspond to the air volumes impinging upon the sheet from above and below. As alluded to earlier, this problem can be obviated by withdrawing recirculating air from the oven in each zone through a restriction, preferably one or more pairs of appropriately perforated plates, positioned across the inlet of each of the illustrated exhaust plenums so that the pressure difference across the restriction between the longitudinal exhaust region and the plenum is large compared to the pressure difference along the plenum. Functionally, the restriction provides an exhaust volume control means which serves to swamp or compensate for pressure drop variations which would lead to non-uniform withdrawal of air across the width of the sheet as well as controlling the ratio of air drawn off above and below. And, to this end, the perforations in the plate are sized so that the pressure drop over the plate is large compared with the pressure drop from one end of an exhaust plenum to the other. Alternatively the holes may be sized to compensate more or less exactly for this pressure drop.

Further with respect to the illustrated recirculating exhaust system, it should be understood that while a single pair of exhaust plenums for each zone has for illustrative purposes been shown in the drawings, a plurality of such pairs may advantageously be used to assure uniform withdrawal depending on zone length. The same, of course, is true with respect to the low pressure, hot air inlet ducts.

In achieving uniformity of sheet heating the effect of radiation within an oven is important. Surfaces which are not close to the mean temperature of the air in a zone, both hotter surfaces such as the high temperature low pressure ductwork and cooler surfaces such as sidewalls, should be arranged as symmetrically as possible relative to the sheet, and minor sheet temperature differentials due to small and unavoidable deviations from perfect radiation symmetry can be compensated for by the intentional exposure to the strip of small areas of unsymmetrically located hot surface. Moreover, since the heat of radiation can be advantageously used for evaporation of solvents, the surface area of the low pressure air supply ducts in the first evaporations zone can be made much larger than is necessary merely to carry hot air to the zone.

Further with respect to heating in the evaporation zones, the function of the evaporation zones is to remove solvent from the coating to such a degree that it can be heated very rapidly in the heat-up zones to curing temperature without blistering or exhibiting other film defects. As a freshly-coated surface heats up and loses solvent, there is at each stage of solvent loss a temperature which must not be exceeded. This temperature is dependent upon the way the solvent is distributed in the film (that is upon the diffusion coefficients for solvent through the thickness of the film). Generally, the less the solvent the higher the critical temperature.

Typical coating materials can be heated as rapidly as is possible to about 175° to 200°, often somewhat hotter, without any defects appearing. Since below this temperature evaporation is relatively slow, and up to it practical finishing systems are tolerant of rapid heating, it is desirable to heat coated sheet to at least this temperature as rapidly as is permitted by such factors as heat economy and the necessity for moderating jet impingement velocity to a value which does not disturb a wet film. However, once a wet coating has reached the maximum temperature which it can tolerate in its particular state of wetness, the rate at which it is then heated must be restricted to one consistent with the rate at which solvent leaves it, in order that at no instant does the temperature exceed that which a film of its particular solvent content and diffusivity can tolerate.

The practical significance of these facts is that it is most desirable to provide a first evaporation zone with a relatively high coefficient of heat transfer and/or operating at a high temperature, and a second evaporation zone with a considerably lower coefficient of heat transfer. In this second zone there should, however, be a moderately brisk stream of air scrubbing the evaporating solvent vapors away from the surface of the coating in order that evaporation not be impeded by the accumulation of high concentrations of solvent in a thick stagnant layer of air adjacent to the sheet, but the velocity of such a stream need be only a fraction of that employed where high heat transfer coefficients are principally sought.

Therefore, in further keeping with preferred aspects of the present invention, the recirculating blower **52*b* for the second evaporation zone is of lower power per unit area of sheet material than the blower 52*a*** for the first zone. Alternatively, a common recirculation blower for the two evaporation zones can be used, with the delivery headers for the second zone containing a smaller percentage of apertured area than the headers in the first evaporation zone.

THE MINIMIZATION OF LEAKAGE INTO THE OVEN

Having in mind that introduction of cold fresh air into the oven system results in significant heat waste, restricting air in-leakage at the oven ends is a further important feature of the present invention. Since in the illustrated system, a pressure differential between the outside and inside of the oven exists, a principal problem resides in eliminating in-leakage or maintaining it at some predetermined controlled small value in spite of the very large openings at the oven ends which are needed to eliminate the possibility of scratching the painted surfaces when the sheet is badly formed or twisted.

Instrumental to this aspect of the present invention is the ability to determine the amount of cold air being introduced at the ends of the oven. In particular the ability to restrict to some desired value in-leakage at the exit end of the oven independent from that at the front end is valuable since such air ultimately travels through the length of the oven and thus provides added ventilation needed, for example when solvent concentrations become excessive. In contrast air which leaks in at the entry end adjacent the exhaust chamber is not available to reduce solvent concentration in the oven itself, represents pure loss to the system and usually should be largely eliminated, e.g., not more than about 500–1000 SCFM.

Figure 5:
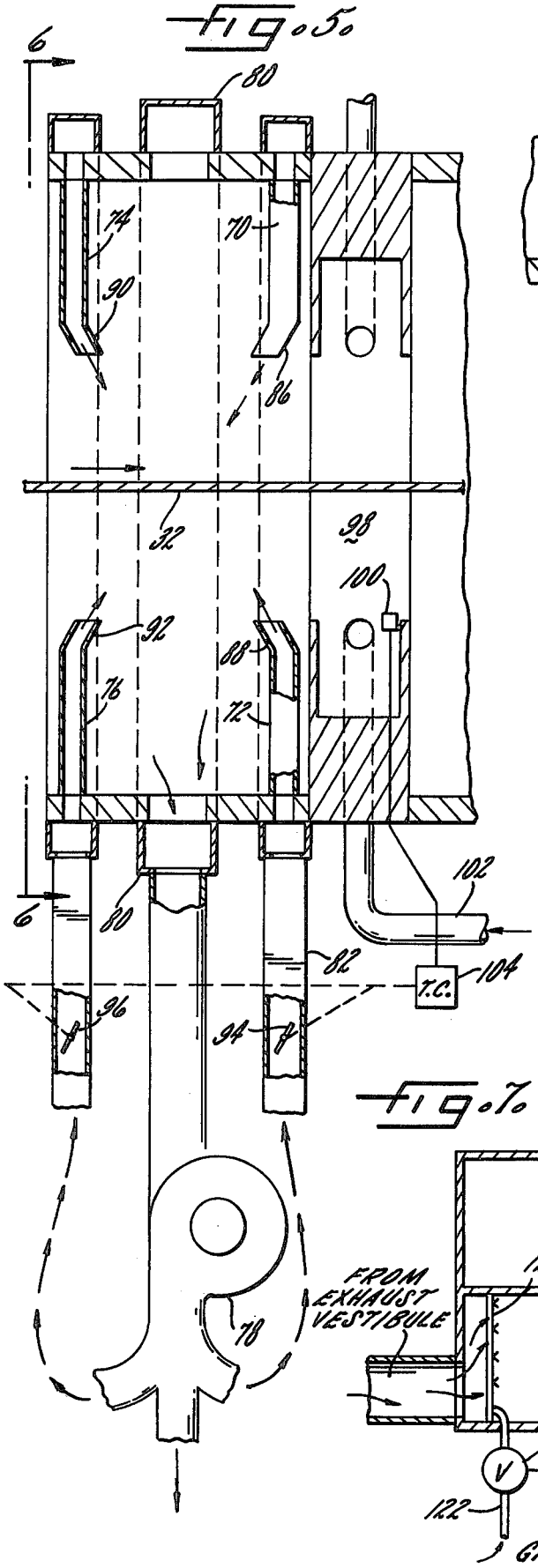
FIG. 5 is an enlarged sectional view illustrating the interior of the seal chamber and associated measuring zone depicted in FIG. 2(a)
Figure 6:
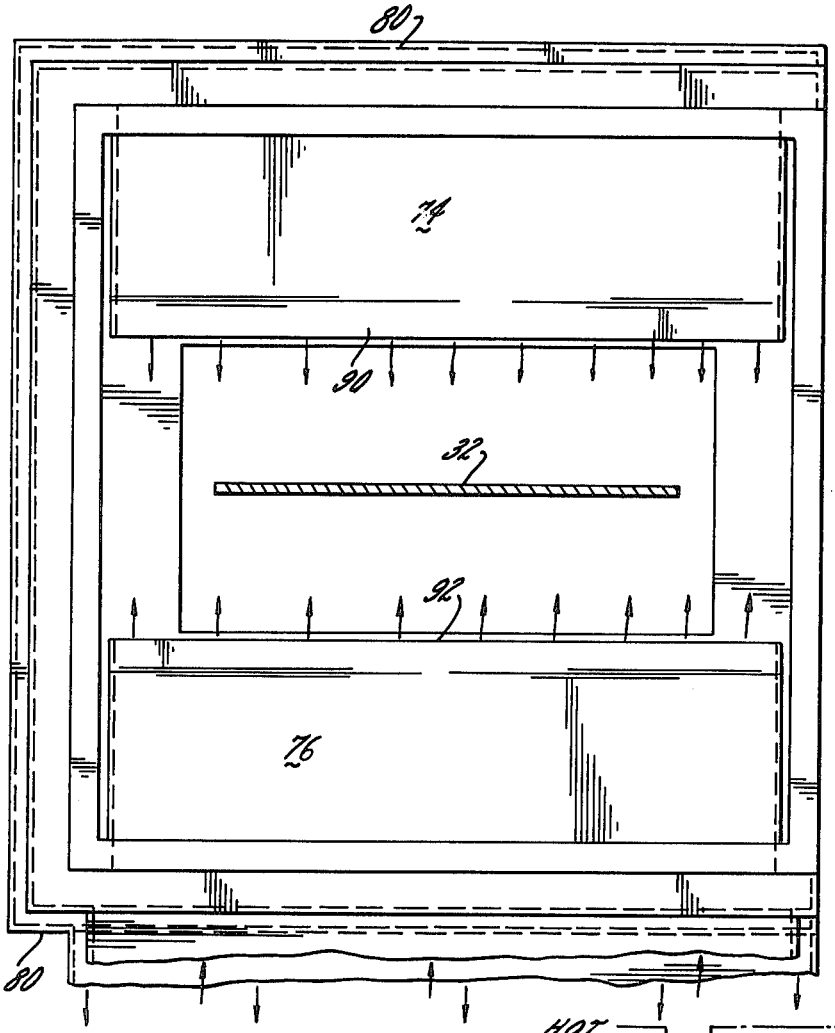
FIG. 6 is an end view of the seal chamber illustrated in FIG. 5 and taken along line 6—6 thereof.

Referring to FIG. 2, the amount of in-leakage at the front end of the oven is controlled in the depicted seal chamber which, as particularly shown in FIGS. 5 and 6, has located therein a set of laterally extending curtain jets 70, 72 disposed on either side of the sheet material 32. Air for the curtain jets is provided by withdrawing air through the exhaust duct 80, from the top and bottom of the seal chamber with the blower 78 and reintroducing air to the jets 70, 72 through the jet feed line 82.

As illustrated, the jets contain discharge openings 86, 88 which are inclined toward the center of the chamber to thereby provide, both above and below the sheet, substantially identical curtain-like air streams directed toward the sheet but in the direction opposite to the travel thereof. An adjustable damper 94 is provided in the jet feed line 82 to control the amount of air blown through the curtain jets which, in turn, controls the amount of in-leakage into the exhaust vestibule from the front end of the oven. Thus, in operation, if the air flow in the jet line 82 is increased, an increased amount of curtain-like air will be introduced in the seal chamber in the direction opposed to sheet travel and to in-leakage. The injection of a few thousands of cubic feet per minute of air in this fashion can support a pressure differential between the exhaust chamber of the oven and the seal chamber of several tenths of an inch of water column while simultaneously preventing the net inflow of air into the exhaust vestibule.

As hereinafter discussed, air passing into the seal chamber through the sheet entry end thereof is desirably used for oven heating and ventilation after regenerative heat interchange with freshly incinerated air. To this end the blower 78 has a volumetric capacity substantially in excess of the volume of air to be reintroduced into the chamber through the curtain jets. While this normally assists the action of curtain jets 70 and 72 in preventing in-leakage at the front end of the oven, the possibility exists that at low exhaust flow from the oven, hot air may be drawn from the oven into the seal chamber. And, in order to prevent this, a second set of curtain jets 74, 76 having discharge openings 90, 92 inclined in the direction of sheet travel or perpendicular to the sheet are desirably provided to oppose the flow of hot air from the oven. The damper 96 is used to control the amount of air introduced through these jets.

Measurement of the amount of flow into or out of the exhaust vestibule can, as illustrated in FIG. 5, be effected in the small mixing zone 98 which is disposed in the path of leakage air and thus is located between the seal chamber and the exhaust vestibule. The mixing zone 98 contains a thermocouple 100 and means such as the inlet duct 102 for introducing a small amount of mixing air of known temperature and causing mixing of this stream with any air flowing into the zone from either the seal chamber or exhaust vestibule, as the case may be. Since the temperature of any horizontally flowing air, the temperature of the mixing air, and the rate of introduction of mixing air are known, the temperature in the mixing zone 98, as sensed by the thermocouple 100, is indicative of the rate of horizontal flow of air through the zone.

The selection of mixing air temperature depends upon the direction of the horizontal flow to be measured. Air from the first evaporation zone recirculating jet supply system can be used if, as is usually the case, only inflows from the seal chamber need be determined and controlled. For example, if the duct 102 is fashioned to supply 100 SCFM of air at 700° F. from the evaporation zone, the temperature in the zone 98 will be about 200° F. if the in-leakage is 500 SCFM of 100° F. air which passes through the seal chamber. If, however, hot air flow out of the exhaust vestibule were to be controlled, then low temperature air such as from the surroundings could be used as mixing air.

Automatic control of in-leakage at a given level, e.g., 500 SCFM, can be effected in the manner illustrated in FIG. 5 by feeding the output of the thermocouple 100 to the temperature control device 104 having a set point, e.g. 200° F., which is predetermined based on mixing air temperature and flow rate, the temperature of in-leaking air and the desired flow rate thereof. The signal from the controller serves to regulate the ratio between the amounts of air forced through the respective sets of jets to thereby provide control of leakage at a predetermined level and simultaneously restrict loss of air from the seal chamber to the atmosphere. As illustrated, therefore, the signal from the controller moves the dampers 94, 96 in opposite senses to appropriate positions at which the preset temperature in the mixing zone is maintained and, in turn, the rate of in-leakage at the front end of the oven controlled irrespective of variations in any of the other oven system parameters or fluctuations in building pressure.

Turning now to the oven exit, the measurement of the in-flow through this end is effected in a manner similar to that described above with respect to the front end of the oven. Accordingly, as illustrated in FIG. 2, the oven is provided with a small exit vestibule 106 containing a thermocouple 108. For introducing a predetermined amount of hot air from, for example, as illustrated the adjacent terminal zone, supply means 110, in the form of an extension of the terminal zone ladders, are provided.

Since the leakage flow at the front end of the oven is independently controlled at, for example, a constant minimum of 500 SCFM, irrespective of the then existing operating oven flow rates, i.e., low pressure hot air or exhaust flow, flow into the oven at the exit is a direct function of any difference between the net hot heating air flows into individual zones and the amount of air exhausted from the oven by the exhaust fan 48 through the exhaust vestibule. And in turn, the control of exit end air leakage can be simply achieved by controlling the amount of air exhausted from the exhaust vestibule or, as later discussed, the flow rate of hot air into the zones.

Therefore, in keeping with the broadest aspects of the present invention and as illustrated in FIG. 2, an adjustable damper 112 is located in the exhaust duct 50. To maintain constant exit in-flow at a predetermined level, a temperature control mechanism 114 such as previously described responsive to the signal from the thermocouple 108 in the exit vestibule adjusts the damper 112 in the exhaust duct to the position at which the predetermined in-flow of air at the exit end exists. Thus the exhaust flow can be made to balance automatically the various oven air inflows when the latter are independent. Similarly, it will be appreciated that if the exhaust flow were independent, oven balance could be achieved by controlling inflow at the oven exit through controller 114 operating on one or more of the dampers controlling air introduction into the oven zones. As will be hereinafter illustrated, this latter approach is especially useful in ovens which are designed for handling large and widely fluctuating rates of solvent introduction.

In view of the foregoing discussion, the advantages accompanying operation of the illustrated oven system are apparent. For the curing of any given metal sheet, desired oven parameters with respect to zone temperatures, hot air impingement velocity, sheet speed and the like can be determined and controller set points established. In steady state operation, in-leakage of cold air at the oven ends is held at a predetermined minimum. As process parameters change, the system automatically adjusts to accommodate such changes in a manner which avoids introduction of undesirable cold air or loss of hot oven air. For example, if the oven heating air increases in temperature, resulting in the introduction of less hot air to maintain oven temperature, the exhaust flow from the oven will be proportionately decreased to maintain exit end in-leakage constant. Similarly, if ambient building pressure increases, adjustment of both curtain jet air flow in the seal chamber and the exhaust flow damper will occur to keep leakage constant. On the other hand, if changes occur in metal sheet gauge or coating composition, which necessitate greater or less heating of the sheet, simple adjustment of high pressure air impingement velocity can be effected to rapidly accommodate such changes without altering the other oven parameters.

The foregoing oven system, utilizing a terminal holding or heating zone, is generally useful for baking sheets which either require that the sheet be continuously heated throughout the oven or heated to a given temperature and then held there for a short period of time. Continuous heating is generally required with respect to heavy gauge sheet and, with respect to such, the terminal zone is operated as a heating zone. Lighter gauge sheet, however, can generally be heated more rapidly, and line speed correspondingly increased. In such cases, the terminal zone can be operated as simply a holding zone for completing curing. For many coating materials, operation in this manner is advantageous since certan coatings develop superior physical properties, with less color change, if they are held at a given elevated temperature for a short period of time prior to quenching.

There are, however, some materials, such as painted aluminum sheets, which benefit from being cooled in air prior to being suddenly quenched in water. Therefore, in accordance with a further feature of this invention, means are provided for optionally operating the terminal zone as a cooling zone, as well as a heating or holding zone as previously described. To this end the terminal zone is provided with means, such as in the form of the illustrated low pressure axial flow type exhaust fans 111 for exhausting hot air from the zone to the atmosphere. Cool air is introduced into the zone by means of the previously described convection heating system for the terminal zone except that, in the cooling mode, the damper **66*e* is closed and the blower 52*e* receives ambient air through the room air inlet duct 112. The duct 112 also contains an adjustable damper 113** which can be closed when convection heating or holding is required in the terminal zone.

It should be recognized that with respect to the control of exit end air leakage, the important aspect is that such be controlled with respect to the principal heating area of the oven. Therefore, in further keeping with this invention, when the terminal zone is operated in the cooling mode, the measurement and control of leakage into the oven heating zones from the terminal zone, rather than from the end of the oven, is important. While not illustrated, this can be effected as previously described by providing a second small vestibule, similar to the illustrated exit vestibule, but between the second heat-up zone and the terminal zone.

INCINERATION OF EXHAUST

Figure 8:
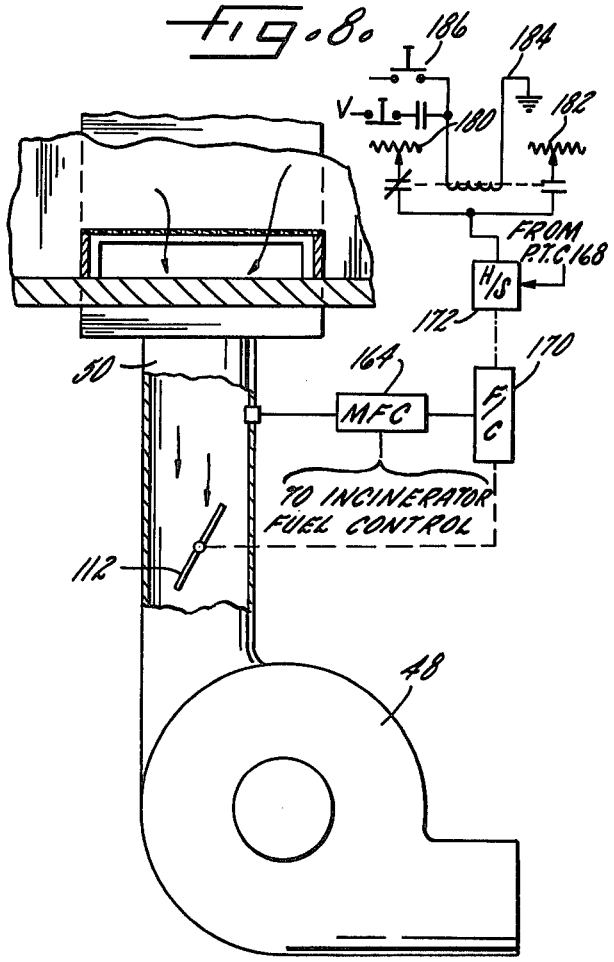
FIG. 8 is a fragmentary view of an alternative exhaust control system provided by the present invention.
Figure 7:
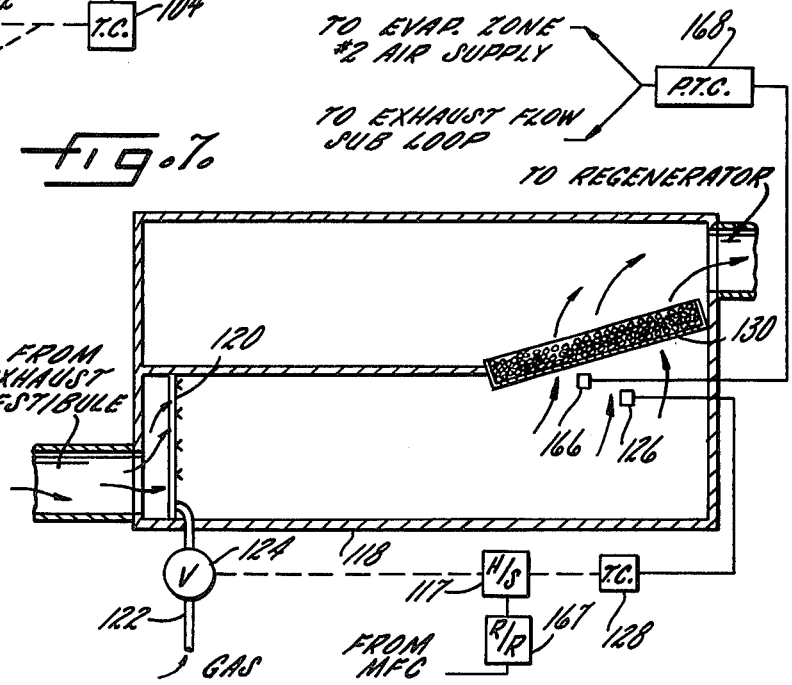
FIG. 7 is a diagrammatic side elevation view of an incinerator embodying features of the present invention.

In further keeping with the present invention and as indicated previously, air exhausted from the oven must generally be substantially completely incinerated prior to discharge to the atmosphere. To this end, as illustrated in FIGS. 7 and 8 exhaust air withdrawn from the exhaust vestibule by the exhaust fan 48 is passed through the incinerator 118. An incinerator flame to provide heat and to initiate combustion is provided by the burner 120 located within and adjacent the incinerator entrance, with the burner being supplied with auxiliary fuel such as natural gas through the fuel line 122. Control of fuel to the burner is accomplished by the fuel control valve 124 located in the fuel line. A suitable burner to provide intimate contact between air and flame is the "Flame-Grid" made by the North American Manufacturing Co. and described in U.S. Pat. No. 3,524,632 to Theodore E. Davies. Temperature sensing means in the form of a thermocouple 126 are located downstream from the burner, in combination with a transmitter, to indicate the temperature of the incinerated air in order to insure that the air discharged from the incinerator is at a sufficiently high value such that incineration of contaminants is assured.

So as to efficiently utilize during the incineration process the heat content of evaporated solvents present in the exhaust stream and to thereby minimize burner fuel requirements when solvent is present, the present invention provides means for adjusting the fuel supplied to the burner as a function of solvent concentration in the exhaust stream and its flow rate. To this end, a minimum acceptable incinerated air temperature is established, and fuel is supplied to the burner only in the amount necessary to maintain this temperature. Thus, as illustrated in FIG. 7, a temperature controller 128 having its set point at the established incinerated air temperature receives input from the incinerator thermocouple 126. Output from the controller 128 acting through high selector 117, hereinafter discussed, as used to appropriately throttle the burner fuel control valve 124 so that only that amount of fuel necessary to augment the heat of combustion of solvent present in order to achieve the preset temperature is supplied.

As to establishing the appropriate incinerator temperature, as illustrated in FIG. 1, the sensible heat of the incinerated air can be used for oven heating. Therefore, for the illustrated system, the set point for the incinerator controller 128 should be at least as high as the temperature which is needed for the low pressure hot air introduced into the oven for heating purposes. However, as mentioned above, it is also necessary that the combustibles in the exhaust air from the oven be substantially completely incinerated. Consequently if the incinerator design and/or flow rate there through were such as to provide insufficient residence time for complete incineration at some temperature which merely satisfied the oven heat requirements, the controller set point would have to be appropriately higher.

In operation, at zero or very low solvent concentrations in the exhaust air, most of the rise in temperature of incinerated air to the set point of the controller 128 is provided by auxiliary fuel supplied to the burner. As solvent concentrations increase and the incinerator air temperature tends to exceed the controller set point, fuel to the burner is correspondingly throttled down, thus effecting efficient utilization of the heat of combustion of the solvent in the exhaust stream. However, as hereinafter discussed, this fuel must never be throttled back beyond the point at which there is a sufficiently robust burner flame to reliably ignite the solvent in the stream.

Referring still to FIG. 7, before leaving the incinerator the incinerated air passes through the filtering means 130 defining a shallow, e.g. 3–12 inches thick, pebble bed for removal of non-combustible contaminates such as silica or other solids. The advantage of accomplishing filtering in the manner illustrated are several fold. Filtering the incinerated air permits its reuse as at least a portion of the low pressure heating air from the oven even when applying coating systems whose vapors result in the production of silica upon incineration. A further advantage of the pebble bed is that in operation it is at incandesence and thus serves to aid in complete incineration, particularly of smokes and particulates. Moreover it acts as a thermal flywheel and tends to stabilize the temperature of the air exiting from the incinerator. Further, as opposed to other filtering means pebble beds are inexpensive, provide large filtering surface area, the interstices are large enough not to plug up rapidly, and when in need of cleaning or replacement can be easily removed.

THE REGENERATIVE HEAT EXCHANGE SYSTEM

In accordance with a further aspect of the present invention, a highly efficient and otherwise advantageous regenerative heat exchange system is provided for transferring the sensible heat of the hot air stream from the incinerator to a cool fresh air stream thereby heating the cool stream. This heat exchange system is interposed between the incinerator exit and the main hot air supply manifold 34 (FIG. 2) and, therefore, the heated fresh air can be used as at least a portion of the low pressure hot air for oven heating.

Figure 10:
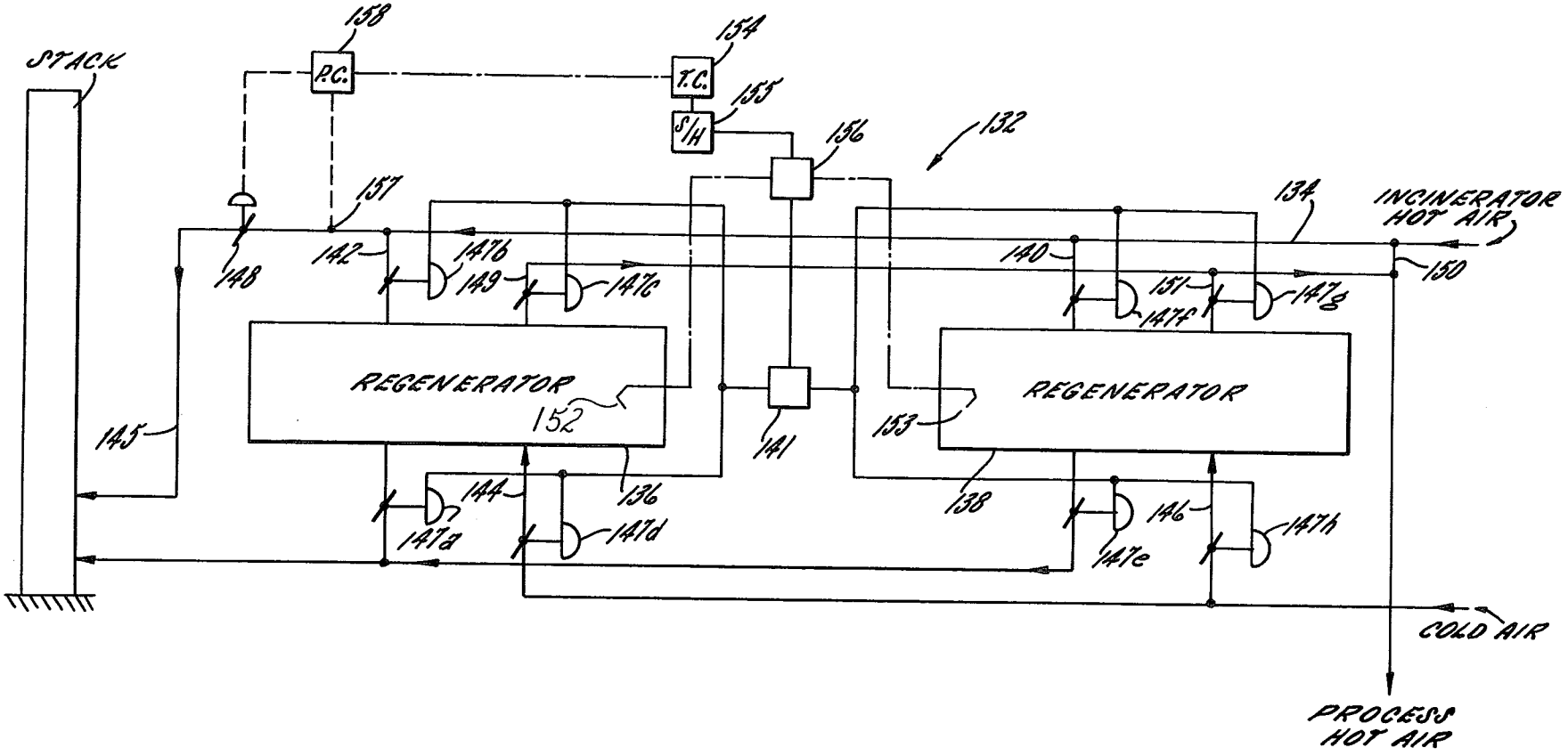
FIG. 10 is a diagrammatic view of a regenerative heat exchange system which can be employed in the oven system of the present invention.

As shown in FIG. 10, hot air from the incinerator 118 is introduced through the supply line 134 into the regenerative heat exchange system 132 which, in the illustrated embodiment, includes a pair of pebble bed regenerators 136, 138. The pebble bed regenerators 136, 138 are arranged in side by side relationship with hot incinerated air, on alternate cycles, entering the regenerators through the inlet lines 140, 142 from the top and cold fresh air entering from the bottom through the lines 144, 146. The advantage of side-by-side regenerators is that the supporting means for the pebble beds need not be designed to withstand the extremely high temperatures which always exist at the one end of each bed.

While incinerated hot air is being passed down through a first of the beds, thereby cooling the air and heating its pebbles, cold fresh air is being heated and the pebbles in the second bed cooled by its passage, in opposite direction, up through the second bed. Appropriate regenerator cycling, i.e., switching operation of the beds, to maintain proper regenerative heat interchange, is effected through use of the open-close valves 147 *a–h* located in the inlet and exit regenerator lines, the positioning of which, as illustrated, is controlled by the cycle controller 141 which typically can be a sequence timer controller. The use of pebble bed regenerators such as those disclosed by P. H. Royster in U.S. Pat. No. Re 19,757 or F. G. Cottrell in U.S. Pat. No. 2,121,733 have been found to provide extremely good regenerative heat interchange.

Further in keeping with the present invention an improved system is provided for controlling the temperature of the regenerators and, more particularly, in a manner such that regenerative heat interchange in the system remains stable over repetitive cycling. Recognizing that process variables, e.g., the temperature or flow rates of the air streams, in a regenerative system can vary, the possibility exists that, unless controlled, regenerative heat exchange can become unstable. Thus, for a given regenerator bed, if a different quantity of heat is removed from the bed during its cooling cycle than was added in the previous heating cycle, regenerator temperatures over a period of time will become either unduly hot or cold.

Therefore, in accordance with a feature of this invention, a regenerative heat exchange control system is provided to maintain stable regenerative heat exchange over repetitive cycling of the regenerators. In its important aspects, this system senses, before switching and in alternate sequence, the temperature, at an intermediate elevation in each bed, of one or the other of the regenerators, and compares the the value sensed to a predetermined operating temperature for that regenerator at that stage of the cycle. If a deviation in temperature is sensed, the flows of both the hot heating air and the cool air are adjusted so as to compensate, in the next cycle, for the variation detected.

FIG. 10 illustrates a preferred form of a regenerative heat exchange system embodying the present invention wherein only a single process variable need be independently adjusted to control regenerator temperature and, in turn, stabilize heat exchange. In this embodiment the process variable which is adjusted is the pressure in the hot air header, such as the supply line 134, which supplies heating air to the system 132. As will be discussed in connection with this figure, an adjustment of this variable automatically effects an increase or decrease in hot air through the regenerator being heated and a compensating, i.e., opposite, adjustment of the flow rate of the cool air stream through the other bed. As a result, for example, if before switching it is determined that the regenerator being cooled during that cycle was cooled too much, then the flow rate of hot air used for heating that regenerator for the next cycle is increased to compensate for this fact. And coincident therewith, the flow rate of cool air through the other regenerator, the temperature of which will then be sensed after completion of the next cycle, is decreased for the next cycle in order to compensate for the noted increased heat withdrawal on the previous cycle.

Turning specifically to FIG. 10, the pressure in the hot air supply line 134 is adjusted by means of a pressure control system which includes an atmospheric exhaust line 145 as an extension of the hot air supply line 134 from the incinerator. So that a change in pressure in the supply line 134 effects a change in the flow rate of hot air through the regenerator being heated, the line 134 is in communication with the then open regenerator hot air inlet line 140 or 142. In turn, the pressure in the line 134 is adjusted by the position of the adjustable damper 148 located in the exhaust line 145. Thus, as this damper is closed or opened, the hot air supply pressure in the supply line 134 is correspondingly raised or lowered and the flow rate of hot air into the then operable inlet line 140 or 142 is increased or decreased.

As indicated above, the illustrated system also serves to automatically adjust, responsive to a change in pressure in the supply line 134, the flow rate through the other regenerator so that, during any cycle, the flow rates are properly coordinated to stabilize the system.

Thus, for example, if, because of excess cooling on the previous cycle more hot air is being forced through one regenerator, then in turn less cool air should be passed through the other regenerator so that excess cooling is not again effected. This is accomplished automatically by providing the illustrated by-pass line 150 which connects the hot air supply line 134 and the then open heated air regenerator exit line 149 or 151. By sizing the by-pass line so that a minimal pressure drop occurs therethrough, variations in the pressure of hot heating air in the supply line 134 will be directly transmitted, as back-pressure, to the then open exit line 149 or 151 which thereby either increases or decreases the flow therethrough. And, since a variation in supply line pressure affects flow rate through both operating regenerators in opposite senses, e.g., by increasing supply pressure for regenerator heating and back-pressure for cooling, proper coordination is realized.

In order to provide for stable automatic regenerator operation each of the regenerators 136, 138 contains temperature sensing means in the form of the depicted thermocouples 152, 153, again as with other temperature sensing means illustrated herein, with associated conventional not shown transmitters, which, on alternate cycles, provide an input signal for the temperature controller 154 which is set at the predetermined desired regenerator temperature. The signal which is compared to the predetermined set point may be the average signal from either bed during its cooling cycle or it may be a signal taken while flow reversal is occurring at the end of a period of cooling. The latter is more economical since, as illustrated, it requires the addition to the standard electronic controller 154 of only a single sample-and-hold unit 155 (e.g., Bell and Howell unit #20–41-9A) and a relay 156 which is responsive to the cycle controller 141.

So as to appropriately adjust the pressure in the supply line 134, responsive to a deviation in regenerator temperature from the controller set point (and, in turn, appropriate adjustment of flow rates through the regenerators), output from the temperature controller 154 provides the set point for the pressure controller 158. In conventional fashion, the controller 158 appropriately adjusts the damper 148 to eliminate any deviation between the set point received from the controller 154 and the pressure in the supply line 134, as sensed by the pressure gauge 157 contained therein which, in combination with a pressure transmitter not shown provides the input process signal for the controller 158.

In addition to providing automatic control of flow rates, the use of the by-pass line 150 is desirable for other purposes. As is recognized, the volume of fresh air blown through regenerator beds 136 and 138 may vary from installation to installation. As a lower limit it must be adequate to maintain an oxygen index at which the incinerator burners receive enough oxygen to burn the solvent and the auxiliary fuel which enters the incinerator. When the preferred flame contact burners are employed the oxygen index in the flue gas must not be allowed to fall below about 11.5 to 12 percent. There is no upper limit since the entire quantity of hot air supplied for heating and solvent sweeping can be fresh. A particularly suitable compromise is to size the regenerators to furnish all of the hot air required under the minimum flow conditions described hereinunder. With use of the by-pass line 150, whatever low pressure hot air is required by the ovens in excess of the volume of fresh air heated in the regenerators, flows directly from the incinerator through line 150. In converse, any quantity of heated fresh air which is in excess of the demands of the oven, flows in the opposite direction through line 150, joining the stream from the incinerator and passing out of the system through the regenerator beds and, in part, through the exhaust line 145 to the atmosphere.

A preferred aspect of the present invention resides in using as the cool fresh air for the regenerative system, air which has been withdrawn from the coating room in which the sheet had applied thereto the desired coating. Upon passage through the regenerator, any solvent in the air entrained during the coating process is oxidized. One convenient method of accomplishing this is to use as the fresh air supply for the regenerative system, air which is drawn into the front end of the oven and exhausted from the seal chamber by the blower 78. Since the previously described oppositely acting damper control system for the seal chamber results in this amount of air being approximately constant, the use of this approach provides a very suitable supply of air for the regenerator without requiring a separate fan.

WHEN HIGH SOLVENT EVAPORATION RATES ARE ANTICIPATED

Where oven temperatures and solvent concentrations are always known to be constant, or very low, safe systems can be easily designed in accordance with the foregoing discussion of run mode operation to meet current safety regulations. All that is necessary is that enough fresh air (whether exit end in leakage or heating air) be continuously introduced into the oven so that the concentration of solvent is always maintained below a given figure: Typically, such concentration is expressed in terms of the lower explosive or flammable limit at room temperature (RTLEL), and generally it is required that the concentration be maintained at less than 25 percent of the RTLEL. As a practical matter what this means is that for every gallon of solvent evaporated per minute in the oven, the minimum exhaust flow from the oven must be approximately 10,000 standard cubic feet per minute.

A problem, however, resides in designing a safe and thermally efficient oven system when widely fluctuating solvent concentrations are anticipated. While a safe system can be designed so that enough fresh air is always introduced into the system during run mode operation so as to accommodate the maximum anticipated solvent loading, ovens so designed are thermally inefficient when operating at low solvent evaporation rates. Thus, for example, the amount of exit end in-leakage can be arbitrarily set at a high value so that, irrespective of solvent loading, the oven exhaust is always safe. In turn, however, when solvent evaporation rates are low, excessive cool fresh air is being drawn through the oven which results in thermal waste since such cool air must then be incinerated and discharged from the system.

Moreover, oven design based on the use of the RTLEL does not account for the fact that oven temperature is rarely constant and, therefore, that the RTLEL is not a truly reliable measure of the margin of safety except when operating near room temperature. It is for this reason that ovens constructed according to conventional practice sometimes experience, intermittently, uncontrolled oxidation of solvent resulting in overbaked product, smoke and occasionally even damage to the oven structure. In this respect, a concentration of solvent which is safe at room temperature, i.e. well below the RTLEL, becomes flammable at some higher temperature.

There is, therefore, a clear need for a thermally efficient system for the control of combustible vapor concentration in flowing gas streams which accounts for both the then existing temperature of the stream as well as the concentration of combustibles therein. In other words, the need is for a control system which is responsive to variations in the "inherent safety" of a stream.

Therefore, in accordance with a further feature of the oven system presented herein, a modified system is provided for safe and thermally efficient oven operation under conditions where widely fluctuating and large solvent concentrations are anticipated. This system can be considered as containing two run modes of operation. The first mode (Mode A) operates in the manner previously described over a predetermined range of combustible vapor concentration in the exhaust air stream, except that exhaust flow mass rate is maintained constant at a predetermined minimum and exit leakage is controlled differently. The second run mode of operation (Mode B) becomes effective when solvent concentration in the exhaust at the minimum flow begins to exceed the predetermined range. In the second mode, exhaust flow rate and introduction of additional sweep air to the oven is directly responsive to variations in rate of solvent entry, so as to prevent the solvent concentration from exceeding a maximum permitted level and thereby maintaining the oven exhaust at a safe condition which, as hereafter discussed, is defined in terms of the "thermal potential" of the stream. In Mode B, and as different from Mode A, the control of fuel to the burner in the incinerator is regulated in accordance with the exhaust mass flow rate so that only the minimum fuel required for reliable initiation of combustion at the then existing flow rate is supplied.

As wil be apparent, the basic differences between the two rum modes of operation are that, in Mode A, exhaust mass flow and incinerator temperature are substantially constant, with the regulation of fuel supply to the burner being responsive to and based directly on solvent concentration in the exhaust stream. In Mode B, a precalculated minimum fuel supply based on the magnitude of the momentarily existing exhaust mass flow rate is used, while at the same time the mass flow rate is adjusted so as to provide a solvent concentration which approaches the maximum desired level. In the second mode of operation, the incinerator temperature is preferably not maintained constant, but rather is made such a function of solvent concentration in the exhaust stream that incinerator temperature is varied in an inverse relationship to residence time in the incinerator. This in turn permits operation of the incinerator at a lower temperature at low rates of exhaust flow, and results in an even greater margin of safety for the system.

Important to the understanding and appreciation of the herein described Mode B operation, is the recognition that the inherent safety of the airstream containing combustible vapors is best reflected by the "thermal potential" of the airstream. The thermal potential is the temperature to which the airstream would rise if the combustibles therein were to be oxidized adiabatically and, therefore, it is a function of both the initial temperature of the airstream and the concentration of combustibles therein. And, since for most combustible vapors, the temperature rise accompanying adiabatic oxidation at fixed concentrations is largely independent of vapor type, when concentration is expressed as a fraction of the stoichiometric concentration, the calculation of the thermal potential of a mixture involves essentially the calculation of the rise in temperature upon adiabatic oxidation, which is a nearly linear function of concentration, and the addition of this value to the temperature of the airstream in question. For example, the temperature rise due to adiabatic oxidation of combustibles in an airstream at 25 percent of the FTLEL (a concentration of about 1 gallon/10,000 SCF) is about 600° F. At a concentration of 40 percent of the RTLEL, this rise is about 950° F. and at 60 percent concentration, about 1450° F. The following table illustrates approximate thermal potentials of airstreams containing such concentrations of combustibles, but at different airstream temperatures.

| | | | | | | | | | |
|---|---|---|---|---|---|---|---|---|---|
| Airstream Temp (° F.) | 70 | 70 | 70 | 600 | 600 | 600 | 900 | 900 | 900 |
| Conc. of Vapor (% RTLEL) | 25 | 40 | 60 | 25 | 40 | 60 | 25 | 40 | 60 |
| Thermal Potential (° F.) | 670 | 1020 | 1520 | 1200 | 1550 | 2050 | 1570 | 1850 | 2350 |

Having the above concept of thermal potential in mind, the inherent safety of an airstream containing combustible vapors is the margin, expressed in temperature difference, between the thermal potential of the stream and the temperature to which the stream would have to be raised in order to effect self-sustaining oxidation of the combustibles therein. As a practical matter, for a rapidly moving stream this latter temperature is the temperature of a weak flame i.e. of a flame burning a mixture of fuel and air at a concentration corresponding to the lower explosive limit at room temperature, or about 2200° F. Therefore, the control system illustrated herein serves to automatically maintain a sufficient margin of inherent safety, e.g. about 900° F., so that the hazards due to flamability are eliminated irrespective of variations in airstream temperature or combustible vapor content.

Referring now again to FIG. 7, it will be appreciated that the temperature of the ignited or incinerated airstream within the incinerator 118 is a function of the heat added to the airstream by combustion of the auxiliary fuel supplied to the burner and the thermal potential of the airstream directed into the incinerator. For the purpose of sensing variations in this temperature when fluctuating and large solvent concentrations are present (Mode B), a second thermocouple 166 is located within the incinerator downstream from the burner 120.

An important aspect of the disclosed system resides in maintaining, during Mode B, at a constant value, the temperature rise of the airstream which is attributable to the heat added by the burner 120 irrespective of variations in the volume of introduced airstream. By so doing, variations in the temperature of the incinerated stream, as sensed by the thermocouple 166, will be very nearly equal to changes in the thermal potential of the introduced stream.

Maintenance of the temperature rise due to burner heat at a substantially constant value during Mode B is effected by balancing the heat output of the burner with the mass flow rate of the airstream through the incinerator so that, irrespective of flow rate, the airstream will always experience the same temperature rise, e.g. 200° F., due to the combustion of auxiliary fuel. In the illustrated embodiment, this is accomplished by modulating the fuel line throttle valve 124 responsive to changes in the flow rate of air directed to the incinerator. To this end, the illustrated system contains a mass flow calculator 164 whose, as illustrated in FIG. 8, flow rate and temperature sensing means are located in front of the blower 48 in the exhaust duct 50. During Mode B, the output from the calculator strokes the fuel line throttle valve 124 through as shown in FIG. 7, a ratio relay 167 and high selector 127 in accordance with a predetermined proportionality so that the fuel supplied to the burner is always sufficient to raise the airstream temperature by a predetermined fixed amount. A suitable system for this purpose is leeds & Northrup Model 6652 mass flow calculator in combination with a standard compatible electronic ratio relay and high selector such as, for example, those in the L & N Electromax III series.

In view of the foregoing discussion, it will be appreciated that changes in the temperature of the incinerated stream, as in sensed by the thermocouple 166 are a direct and linear function of changes in the thermal potential of the airstream directed to the incinerator. Therefore, a signal from this thermocouple can be used to control the thermal potential of the airstream. Accordingly, a further aspect of the system resides in utilizing the signal from the thermocouple 166 to control the thermal potential of the airstream directed to the incinerator and to thereby maintain a safe margin of safety within the oven.

Figure 9:
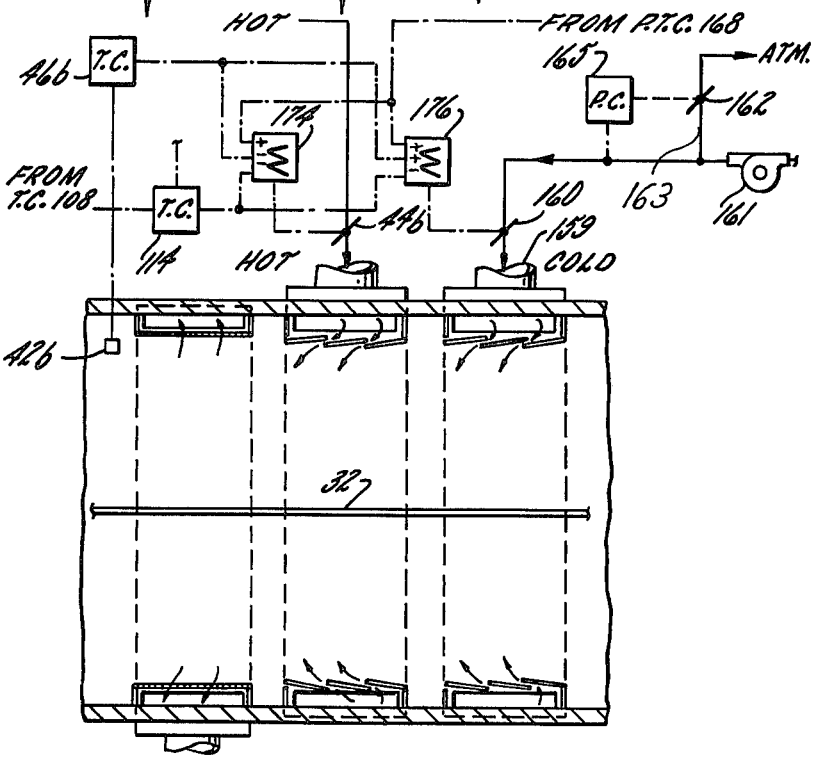
FIG. 9 is a fragmentary side elevation view of the second evaporation zone illustrated in FIG. 2, and depicting an air supply control system therefore.

To this end and as illustrated in FIGS. 7 and 9, the signal from the thermocouple 166 is fed to the temperature controller 168, the output signal from which is used to regulate thermal potential in the oven by adjusting the concentration of combustible vapors therein, as hereinafter described. Typically, with respect to large scale industrial painting ovens, the controller 168 should, for adequate safety, maintain the thermal potential of the airstream at less than about 1300° F., i.e., a margin of safety of about 900° F. (2200° F. minus 1300° F.). In turn, the set point of the controller should be about 1500° F. if the temperature rise due to burner heat is preestablished as being about 200° F.

Adjustment of the thermal potential of the airstream in the oven is accomplished by varying the flow rate of fresh air introduced into the second oven evaporation zone and, in turn, the concentration of combustible solvent evaporated into the stream in this zone. As hereinafter discussed, it is desirable that the temperature in the oven zone be maintained constant over such varying flow rates and, accordingly, simply varying the flow rate of the hot air introduced to adjust thermal potential is not preferred. Therefore, as illustrated, in FIGS. 2 and 9, the oven zone contains an inlet duct 159 for the introduction of cold fresh air. In order to balance the introduction of cold and hot fresh air to, as will be described, maintain constant zone temperature, the flow rate of cold air is regulated by the damper 160 positioned in the duct 159. So that a constant cold air supply is provided for the zone, the cold air supply system contains, in addition to the blower 161, a back pressure relief damper 162 in the relief duct 163 which affords an exhaust path to the atmosphere, and an associated pressure controller 165.

Referring still to Mode B operation and as previously described, thermal potential is controlled by the temperature controller 168, the signal from which indicates whether more or less fresh air should be introduced into the second evaporation zone of the oven. So that the exhaust flow rate from the oven is balanced with the amount of additional fresh air introduced therein, the signal from the temperature controller 168 serves to effect adjustment of both the rate of fresh air introduced into the oven (both hot and cold) and the amount of exhaust withdrawn by the exhaust blower 48. To this end, the signal from the controller 168 is also used for the purpose of appropriately regulating the adjustable damper 112 positioned in the exhaust duct 50.

More specifically, and as illustrated in FIG. 8, control of exhaust flow rate is effected by the flow controller 170 which positions the damper 112 in the exhaust duct. The set point of the controller 170 comes from the high selector 172 whose inputs are (a) the aforementioned signal from the temperature controller 168 and (b) as will be hereinafter described, minimum flow rate signals used for Mode A and idling mode operations. The process variable (input flow rate signal) for the flow controller 170 is provided by the mass flow calculator 164 which, as heretofore described also influences the fuel throttle valve 124, thus regulating fuel to the incinerator burner 120 in accordance with airstream flow rate.

As mentioned previously, it is desirable to maintain the temperature in the oven zone substantially constant by balancing the introduction of both hot and cold fresh air. Referring again to FIG. 9, avoidance of an undue upset in zone temperature while changing the total flow of hot and cold air into the zone is accomplished by forwarding the fresh air demand control signal from the controller 168 to both the adjustable damper **44*b* in the hot air supply duct and to the adjustable damper 160 in the cold air supply duct through the respective summers 174, 176, as well as to the exhaust flow control system as above described. The output from the zone temperature controller 46*b***, which is also directed to the summers, effectively varies the ratio between the hot air and cold air introduced into the zone so as to maintain the zone temperature at a constant preset value.

With respect to further understanding the foregoing, if only cold air were introduced, then some seconds later the zone thermocouple **42*b* would recognize that the introduced cold air had dropped the zone temperature below its preset level and would effect injection of additional hot air. In turn, the incinerator controller 168** would first receive the input from the air solvent stream diluted by cold air and then a stream further diluted by hot air and it would change its demand for air accordingly. Unless the hot air loop were very fast relative to the cold, cycling would occur. A fast cold air loop, however, is desirable for safety purposes. Therefore, for the purpose of avoiding oscillation, the advantages of the illustrated forward feed control system to both the hot and cold air supplies are apparent.

Also with the objective of minimizing oscillation, the amount of in-leakage from the oven exit is controlled constant in Mode B, (and also in Mode A) by appropriately trimming the fresh air introduced into the second evaporation zone, rather than by varying the exhaust flow rate as heretofore described. Thus, as illustrated in FIG. 9, the output from the exit vestibule direct-acting temperature controller 114, operating off the thermocouple 108, is also directed to the summers 174, 176, to influence the air introduced into the second evaporation zone so as to maintain exit in-leakage constant.

As mentioned earlier, a function of the incinerator is the substantially complete oxidative and thermal destruction of the solvent vapors evaporated in the oven so that discharge of the exhaust to the atmosphere is possible. In this respect, both the temperature to which the airstream is raised in the incinerator and the residence time of the airstream therein are important. Shorter residence times, of course, require higher temperatures to insure incineration, with lower temperatures being possible as residence time is increased. Furthermore, operation of the incinerator at the lowest temperature necessary to effect solvent degradation for the then existing flow rate is desirable in order to avoid excessive heat losses.

Accordingly, a further preferred aspect of the illustrated system involves the use of the system heretofore described for both controlling thermal potential of the oven exhaust zone and for effectively varying the temperature of the incinerated air relative to the then existing exhaust flow rate so that incinerator temperature and residence time are coordinated so as to permit lower temperatures at lower flow rates. Important in accomplishing this is the use, as the temperature controller 168, of a proportional only controller rather than simply a narrow band controller with rest function. The latter type of controller holds the delivery temperature of the incinerator substantially constant with exhaust volume being forced to be proportional to solvent evaporation rate in the oven. With the use of a proportional only controller, incinerator delivery temperature is variable, being lower at lower flow rates, i.e., longer residence times, wherein, in fact, such lower temperatures can be effectively used to accomplish incineration.

Still with respect to this aspect and in order to maintain a safe thermal potential for the oven stream, the upper limit of the band of the proportional controller is set, as previously discussed, at that temperature which represents the highest permissible thermal potential of a safe stream of the exhaust to the atmostphere is possible. In this respect, both the temperature to which the airstream is raised in the incinerator and the residence time of the airstream therein are important. Shorter residence times, of course, require higher temperatures to insure incineration, with lower temperatures being possible as residence time is increased. Furthermore, operation of the incinerator at the lowest temperature necessary to effect solvent degradation for the then existing flow rate is desirable in order to avoid excessive heat losses.

Accordingly, a further preferred aspect of the illustrated system involves the use of the system heretofore described for both controlling thermal potential of the oven exhaust zone and for effectively varying the temperature of the incinerated air relative to the then existing exhaust flow rate so that incinerator temperature and residence time are coordinated so as to permit lower temperatures at lower flow rates. Important in accomplishing this is the use, as the temperature controller 168, of a proportional only controller rather than simply a narrow band controller with reset function. The latter type of controller holds the delivery temperature of the incinerator substantially constant with exhaust volume being forced to be proportional to solvent evaporation rate in the oven. With the use of a proportional only controller, incinerator delivery temperature is variable, being lower at lower flow rates, i.e., longer residence times, wherein, in fact, such lower temperatures can be effectively used to accomplish incineration.

Still with respect to this aspect and in order to maintain a safe thermal potential for the oven stream, the upper limit of the band of the proportional controller is set, as previously discussed, at that temperature which represents the highest permissible thermal potential of a safe stream plus the predetermined temperature rise due to the burner heat. As to the lower limit of the band, this is arbitrarily set to be several hundred degrees less than the upper limit so that when a signal is first emitted the airstream in the evaporation zone is several hundred degrees below its maximum permissible thermal potential. The set point of the proportional controller is placed midway between the upper and lower levels of the proportional band and the manual reset function of the controller is adjusted to produce an output of 50% when the temperature of the incinerator is at the set point of the proportional controller 168.

Having in mind that the foregoing control system is designed for Mode B type operation where rates of solvent evaporation are anticipated to widely fluctuate and that, when such conditions are not present, the use of the system first described herein (Mode A) is desirable, means are provided so that operation of the respective temperature controllers 128 and 168 is mutually exclusive. To this end, the set point of the controller 128 is positioned somewhat below the lower limit of the proportional band of the controller 168 and the output from the controller 128 goes to zero when the incinerator temperature appreciably exceeds its set point. Similarly, so that the fuel valve 124 is appropriately controlled, depending on which system is operative, the position of the valve is modulated, as before indicated, through the selector 117 by the higher of (a) the output signal from the temperature controller 128, which represents the auxiliary fuel necessary to reach incineration temperature in Mode A, and (b) a signal, proportioned by ratio relay 167, from the output of the mass flow calculator 164, representing the fuel required to heat the then existing exhaust flow stream a predetermined amount. Suitable high selectors are available in L & N's Electromax III and numerous other lines of process instrumentation.

Still referring to this system, so that the oven zone can accommodate some minimum rate of solvent input, the flow rate of air therein in Mode A is preferably maintained at a preselected constant value which, typically, would be on the order of 5000 SCFM for a primer oven and, partially in anticipation of a sudden commencement of the introduction of solvent at a rate of at least one gallon per minute, of 10,000 SCFM in a finish oven. Such control of flow rate at the preselected minimum is effected by a signal to the exhaust damper 112 from the flow controller 170 which receives its set point from the high selector 172. And, so long as the output of temperature controller 168 is zero, the highest input to this high selector is the preselected minimum flow signal, or in the hereafter discussed idling mode, the idling minimum flow signal.

In light of the above description, operation of the oven system illustrated herein can be readily understood. During start up or when coatings with low solvent contents are used, the incinerator temperature will be maintained close to the set point of the temperature controller 128 which, in turn, regulates fuel supplied to the burner 120 so that an adequate incineration temperature is maintained. So long as the incinerator temperature does not exceed the set point of the controller 128, the flow rate of the airstream within the oven is maintained at a present constant minimum value by the flow controller 170. As the rate of solvent evaporation increases in the oven, fuel to the burner is progressively throttled down so as to efficiently utilize the heat of combustion of the evaporated solvent in the incineration process. However, it should be understood that the fuel valve must not be closed to such an extent that, at the preselected minimum flow rate, an insufficient flame to reliably ignite combustion would be present. Thus, for example, a minimum flame should always be provided which is sufficient to raise the temperature of the airstream at minimum flow at least about 200° F. In accordance with this invention fuel valve 124 is held sufficiently open by the signal from the mass flow calculator acting through the ratio relay 167 and high selector 117 to assure this minimum flame.

Referring still to operation of the illustrated system, when the rate of solvent evaporation becomes so large as to result in an incineration temperature which enters into the proportional band of the controller 168, this controller sends out an air demand signal. This effects introduction of both hot and cold fresh air into the oven and appropriately increases the exhaust flow rate from the oven. At the same time the output of controller 128 goes to zero so that the signal which adjusts the fuel to the burner is that originating at the mass flow calculator so that the airstream temperature rise due to the heat of the auxiliary fuel becomes constant. As solvent evaporation rates and airstream flow rates increase still further, the incinerator progressively becomes hotter until should the upper limit of the proportional band of the controller 168 be exceeded, the introduction of solvent into the oven would be stopped automatically such as, for example, by opening the coaters applying solvent to the sheet being processed.

As is apparent from the foregoing description, three basic modes of oven operation have been described, i.e., mode A run wherein oven temperature, exhaust flow and incinerator temperature are constant, mode B run wherein oven temperature is constant but exhaust flow and incinerator temperature vary, and an emergency stop mode wherein exhaust flow and incinerator temperature are constant, but oven temperature is lowered. In accordance with a further feature of the present invention, a fourth mode of operation is also provided. This mode, termed the idling mode, is effective when no coating is being applied to the sheet material such as, for example, when the type of coating being used is being changed. This mode is entered into manually and, so that normal run operation can be thereafter promptly initaited, oven temperature is maintained at the run mode level during idling operation.

In its important aspects, in idling mode operation, the coaters are "locked out" so as to be incapable of being advanced into an operable coating position and, coincident therewith, the exhaust flow from the oven is reduced to a value below the minimum flow of mode A. Since during idling mode operation, the coaters are inoperative, the necessity of providing air for solvent dilution is not present, and the only requirement as to oven air is that it be sufficient to maintain oven temperature. Thus, for the purpose of permitting idling mode operation, a third set point, corresponding to the desired flow rate during idling, may be provided for the mass flow controller 170, or its set point may be reduced by the output from vestibule temperature controller 114. As illustrated in FIG. 8 and as heretofore discussed, the high selector 172 is used to provide the appropriate set point signal for the controller.

Typically, and in conventional fashion as illustrated in FIG. 8, the idling mode set point and the mode A set points can be provided by adjustable potentiometers 182 and 180, respectively, the selection therebetween being effected by means of a relay 184 which, in mode A run operation, is normally deenergized. An on-off push button 186 or a signal from the line dr: can be used to energize the relay for idling operation so that the output of the idling potentiometer is used as a set point for the exhaust mass flow controller 170. When energized, the relay also can be used to open the circuits used for the coaters to that during idling, it is impossible for the coaters to be advanced into position, thus insuring against the possibility of introducing solvent during this idling mode.

In accordance with a further feature of idling mode operation, the incinerator temperature may be reduced so that additional fuel saving can be effected. In this respect, during idling, the temperature of incinerated air need only be sufficient so as to assure that, on regenerative heat interchange with fresh air, oven temperature is maintained. Since during idling there is no solvent present, the necessity for incineration is absent. As a result, during idling, the incinerator temperature can be lower than that required during run mode operation and, to this end, when the relay is energized, it is possible to use a lower set point for the temperature controller 126. Accordingly, the controller 126 is preferably of the previously described cascade or computer supervisory set type and a signal from the relay 184, when energized, is used to adjust the set point of the controller 126 to a lower value.

THE USE OF MULTIPLE OVENS

While the incineration and heat regenerative aspects of the invention have been heretofore described in connection with a single oven, it is to be understood that two or more ovens can be employed in the system. And in this respect, a further aspect of the present invention resides in providing an oven system including a plurality of ovens, such as both a primer and finish oven, wherein, prior to incineration, the exhaust streams from the ovens are combined and forwarded to a single incinerator. Combining exhaust streams prior to incineration is accompanied by significant advantages when it is anticipated that the rate at which solvent is evolved in, and therefore frequently the volume of exhaust air from, the respective ovens in the system will be markedly different.

One advantage is that the exhaust fan or fans used for withdrawing air from the ovens can have smaller capacities than those which would be needed if each oven were provided with an independent fan. For example, if the ovens are designed so as to require an exhaust flow of 20,000 SCFM at maximum solvent loading and separate and independent fans are used, each fan must have this maximum capacity. However, if it is known that all of the ovens in the system will not, at the same time, be requiring maximum exhaust flow, a fan or fans of lesser capacity can be advantageously used. The use of smaller fans for the primer and finish ovens used in the coil coating industry is usually possible since the quantity of solvent evaporated in the primer oven and, in turn, the needed exhaust flow is generally far less than that in the finish oven. Thus, in many cases, a single exhaust fan having a capacity of, for example, 30,000 SCFM can be used instead of two fans, each of which can handle 20,000 SCFM.

Combining exhaust flows and the use of a single incinerator is, for much the same reasons, advantageous in reducing the needed maximum incinerator volume. Moreover, conventional incinerator burners are not designed to accommodate wide variations in mass flow rate. By combining exhaust flows, the maximum design variation can be reduced. For example, in a two oven two incinerator system wherein each oven can handle 5000 to 20,000 SCFM, each burner must accommodate a mass flow rate ratio of four to one, whereas if with a single incinerator from 15,000 to 30,000 SCFM the burners would only be subjected to a flow ratio of two to one.

Furthermore, it will be appreciated that a single regenerative heat exchange system can be employed with multiple ovens. And in combination with a single incinerator, the heat of combustion supplied by solvent from one oven which is in excess of the heat needs of that oven can be readily used to supply heat to another oven, which might, for instance, be operating on a water-based primer and hence not furnishing any solvent to assist in its heating.

As will be appreciated, the system heretofore described for controlling thermal potential is directly applicable with respect to the use of a single incinerator in combination with a plurality of ovens, only one of which is operating with variable exhaust-flow rate and providing solvent for the exhaust stream. Any change in incinerator temperature will reflect a change in thermal potential of the exhaust from the oven in which solvent is being evaporated. And, the control of thermal potential in that oven can be accomplished as described and with the mentioned advantages.

However, it should be understood that changes in incinerated air temperature are under these conditions, a non-linear function of changes in thermal potential of the solvent containing stream. Thus, a given incinerator temperature rise due to a rise in thermal potential is actually less than the increase in thermal potential of the stream. Accordingly, the output of the proportional controller must be appropriately augmented to provide a signal for the set point of the mass flow controller and air supply system to maintain safe conditions. The use, in combination with the temperature controller 168, of an associated diode curve shaping network, such as can be assembled from three or four Bell and Howell Model 19-306-1 segment units, can impose on the system a non-linear relationship between incinerator temperature and exhaust flow from the oven which will ensure a margin of safety in that oven.

The above illustrated system is also useful in those instances when, although solvent is being evaporated in more than a single oven, it is known that only one of the ovens will necessitate operation in Mode B, and that, with respect to the other ovens, these can always be operated in Mode A with moderately small fixed flows of exhaust air, i.e., the maximum anticipated solvent concentration therein will be such that a safe thermal potential can always be assumed to exist. In this situation, a change in incinerated air temperature cannot necessarily be interpreted as being due to a change in the thermal potential of the oven in Mode B operation. However, for safety, the system must be designed as above indicated as if such were always the case. And, while this can result in the occasional introduction of unneeded fresh air, the advantage of using only a single incinerator is nevertheless realized.

Where more than one of the ovens included in the system will be experiencing variable exhaust flow rate, little advantage can be realized by using changes in the temperature of the incinerated air in a main incinerator to control thermal potential. However, advantage can still be taken of use of a single main incinerator by controlling the inlet air and exhaust flows in each oven exactly as described above with respect to a single oven except that the temperature sensor for the Mode B controllers for each oven are in small separate model incinerators fed with a small fraction of effluent from a single oven instead of being in a large common main incinerator.

More particularly, each of the model incinerators has its own mass flow calculator, flow and temperature controllers and burner fuel proportioning means as previously described. However, since the model incinerators are used for control purposes and the consumption of burner fuel therein is very small, the model incinerators need not contain the burner fuel control system features for Mode A operation. However, such, of course, is not the case with the main incinerator. Therefore, the main incinerator should still contain the illustrated Mode A and B burner control means including the mass flow calculator 164, but the incinerator does not need to be equipped with the flow controller 170 and the temperature controller 168 need only be utilized to signal excessive incinerator temperature.

As heretofore described, incinerator temperature, in Mode B, is a direct function of thermal potential of the airstream introduced into an incinerator because the temperature rise due to burner heat is maintained constant over varying flow rates. As illustrated, this is accomplished by appropriately proportioning mass flow rate to burner fuel. The same result, i.e., a constant temperature rise due to burner heat, can be achieved by maintaining constant both the mass flow rate through the incinerator and the amount of fuel supplied to burner. Achieving this is difficult with respect to large flow rates wherein airstream temperature may appreciably fluctuate. However, with respect to small flow rates, such can be conveniently accomplished and, therefore, this approach to achieving a constant temperature rise due to burner heat can be used with respect to operation of model incinerators when such are employed.

Therefore, in accordance with a preferred aspect of the invention disclosed herein, a system is provided for operating an incinerator, and preferably a small incinerator, such that the mass flow rate of an airstream directed therethrough remains constant over varying temperatures of the introduced airstream. This is accomplished by drawing the airstream through the incinerator with a fixed volume fan and, interposing between the incinerator exit and the fan, means, such as a water spray chamber, for cooling the incinerated air to a constant temperature.

As a result of the use of the constant volume fan in combination with the introduction of constant temperature air into the fan, the mass flow rate of air drawn through the incinerator is constant irrespective of the temperature of the airstream. In turn, so long as the fuel supplied to the incinerator burner is held constant, the temperature rise of the airstream due to burner heat also remains constant. As will be apparent, the advantage of controlling temperature rise in this fashion resides in the ability to eliminate the necessity for the mass flow calculator and means for modulating burner fuel responsive to changes in mass flow rate.

THE CONTROL OF SHEET POSITION WITHIN THE OVEN

As indicated previously, the illustrated oven should have the configuration of a caternary so as to approximate the shape in which any suspended sheet hangs. As is recognized, it is desirable that caternary ovens be provided with automatic control means so that the sheet does not scrape the top or the bottom of the oven. Such control has been achieved by varying the tension on the sheet within the oven typically by drive bridle motor armature current control based on visual observation or by attempting to maintain automatically a constant capacitance between the sheet and a relatively narrow and closely spaced capacitor plate located adjacent to one end of the oven.

Such an automatic system, however, has several prominent shortcomings. Since near the middle of the oven the sheet can rotate unsymmetrically, one edge dropping more than the other one rises, maintaining the clearance between plate and sheet to a fixed value near one end does not centralize the sheet near the middle of the oven where scratching is most likely to occur. Secondly, it is necessary at more or less frequent intervals to change the width and thickness of the sheet being processed. When a strip of greater weight per unit of length is joined to one of lesser weight per unit of length and the resulting joint is pulled through the oven, the heavier sheet tends to sag, and the lighter sheet to be pulled up with respect to the position of a sheet of uniform cross-section. If a sensing plate is located near one end of the span, the tension in the sheet may be controlled so that the sheet is in the proper plane at the sensing plate, but beyond the joint it will be above or below its intended position, often to a degree which allows it to scratch the bottom (or less frequently) the top of the oven.

Now in accordance with a further aspect of the present invention, an improved catenary control system is provided. One of the important features of the system involves the positioning of capacitive sensing means at a point in the central region of the catenary span where the difference in elevation per foot of length is small. By so locating the capacitive sensing means, adequate control of sheet position can be achieved even when sheets of widely different weights are joined together.

In order to eliminate the confusion which exists with single capacitor plates between motion of the strip away from the plate on one hand, and sheet twisting especially if combined with lateral motion on the other, to substantially linearize the output signal, and to permit the plates to be spaced as much as two feet from the nominal position of the sheet, the present system includes a pair of sensing plates. These plates are wider than the sheet being processed, so as to be insensitive to twisting and to lateral displacement of the sheet and are spaced equidistantly above and below the normal position of the sheet. However, as the sheet twists through increasing angles, the error signal produced by a given sheet displacement decreases.

Therefore, in accordance with a further feature of the present catenary control system, a radiation responsive sheet position sensing system is provided for detecting the position of sheet which has rotated substantially so that it significantly intercepts horizontal beams of radiation. This system includes sources of radiation located on one or both sides of the oven in vertical array, and radiation detecting means and optionally retroreflective means so arranged as to cancel out effects due to particular direction or sense of the sheet twist but sensitive to its vertical displacement only. Such radiation responsive sensing systems are customarily used for sensing horizontal sheet displacement in continuous web processing. Fife Corp., North American Mfg. Corp., and others supply such systems.

In operation, the capacitive and radiative error signals are preferably summed to provide a composite signal of symmetry and adequate sensitivity to vertical displacement to permit control thereof, irrespective of sheet twisting.

I claim as my invention:

1. In an oven system for the continuous thermal treatment of material, the combination comprising, an oven through which said material is conveyed defining an elongated housing having a principal material heating area, an inlet opening for the introduction of material and an exit opening for the removal thereof, sealing means adjacent at least one of the openings for restricting leakage of air into the balance of the oven through said sealing means and control means for maintaining such leakage at a predetermined level independent of then existing operating oven flow rates, a hot air supply source and hot air supply means communicating therewith and opening into the heating area of said oven, to thereby provide substantially all of the heat requirements thereof, an oven exhaust system for removing air from the oven, a fuel fired incinerator, the inlet thereto communicating with said exhaust system, for incinerating and heating substantially all of the air stream exhausted from said oven, and a regenerative heat exchange system interposed between the exit of said incinerator and said hot air supply source for heating fresh air to thereby provide at least a portion of the hot air for said hot air supply source using the heat content of incinerated air from said incinerator.

2. The system of claim 1 in which the sealing means is adjacent only one of the openings, such system also containing means for separately controlling, at a predetermined level, leakage of air into the heating area of said even through the other of such openings.

3. The system of claim 2 in which said sealing means is adjacent the oven inlet opening and includes a seal chamber, and said oven exhaust system is disposed between the seal chamber and the oven heating area so as to thereby effect sweeping of hot air through the principal material heating area of said oven in a direction countercurrent to that of material travel.

4. The system of claim 3 wherein the means for controlling leakage through the exit opening includes means for measuring variations in the flow rate of such air leakage and means, responsive to measured variations in said leakage, for adjusting then existing operating oven air flow rates to thereby control exit end air leakage at a predetermined level.

5. The system of claim 4 wherein the seal chamber includes an air supply system for forcing air into said chamber through a set of curtain air jets which are located within said chamber, are disposed on opposite sides of the material and extend laterally thereacross, said air jets containing inclined discharge openings to provide, both above and below said material, substantially identical curtain-like air streams directed toward said material in the direction opposite to the travel thereof, exhaust means opening through the top and bottom of said chamber for exhausting from said chamber air forced therein through said jets, wherein control of leakage therethrough is effected by regulating the amount of air forced through said jets to thereby provide control of leakage through said seal chamber independent of operating oven air flow rates.

6. The system of claim 5 wherein the seal chamber includes second curtain air jets for providing curtain-like air streams directed toward said material but perpendicular to or in the direction of travel thereof, and means of regulating the ratio between the amounts of air forced through the second of said jets relative to that introduced through the first set to thereby provide independent control of leakage at the predetermined level and simultaneously restrict loss of air from said seal chamber to the atmosphere.

7. The system of claim 6 including means for measuring variations in the flow rate of air leaking through said seal chamber, the regulation of air to the curtain jets being responsive to the measuring means so that, incident to a change in leakage, the amount of air forced through the curtain jets or the ratio of air forced through the first set with respect to that forced through the second is adjusted to maintain inlet air leakage at a predetermined level.

8. The system of claim 7 wherein the means for measuring variations in the amount of exit and inlet air leakage comprise separate temperature sensing means located within independent mixing chambers disposed in the path of the leakage air, each of said chamber containing means for introducing a known amount of mixing air at known temperature so that variations in the flow rate of leakage air through said chambers are reflected by variations in the temperature of air in the mixing chambers as sensed by the temperature sensing means located therein.

9. The system of claim 1 which includes a convection heating system for the principal material heating area, said convection heating system comprising hot air delivery means disposed on either side of the material which includes an array of apertured delivery headers which separate the oven into longitudinal exhaust flow regions adjacent the top and bottom of the oven and convection working regions adjacent the top and bottom of the material and an air supply system for supplying air to the apertured headers, the apertures of said headers being positioned to face said sheet material and being sized so that air delivered therethrough enters the working region in the direction substantially vertical to the material and at a high velocity to thereby achieve a high convection heat transfer coefficient, the array of the apertured headers being sufficiently open so that a substantially vertical return air path, rather than a longitudinal or lateral path is provided for air after impingement with said material.

10. The system of claim 9 wherein the air supply system for the headers includes means for withdrawing air from the longitudinal exhaust flow regions of the oven through withdrawal plenums and recirculating the air withdrawn back into the oven through the delivery headers.

11. The oven of claim 9 containing means for adjusting the velocity of the substantially vertically impinging air to thereby permit control of the convection heat transfer coefficient.

12. The system of claim 10 wherein the proportions of air withdrawn from the longitudinal exhaust flow regions above and below the material are substantially proportional to the volumes of air introduced through the headers above and below the material respectively.

13. The oven of claim 12 wherein the pressure drop across the apertures in the air supply headers is large compared to the pressure difference along a header, and the pressure difference across a restriction between the longitudinal exhaust region and the withdrawal plenum is large compared to the pressure difference along the plenum.

14. The oven of claim 13 wherein the open area between the air supply headers is at least 60% of the projected area of the array.

15. The system of claim 1 which contains means, responsive to the presence of combustible vapors in the air stream exhausted from said oven, for regulating fuel supplied to the incinerator so as to maintain, at a constant value, the temperature of the air exiting from said incinerator over a predetermined range of combustible vapor concentration in said stream.

16. The system of claim 15 which contains fixed flow control means for maintaining, at a constant value, the flow rate of the air stream exhausted from said oven while the concentration of combustible vapors in said stream is within said predetermined range.

17. The system of claim 16 which also contains variable flow control means, responsive to an increase in combustible vapor concentration above said predetermined range, for increasing the flow rate of air into said oven and of the air stream exhausted therefrom to thereby maintain a safe concentration of combustibles within said oven.

18. The system of claim 17 wherein the oven includes cold fresh air supply means for introducing cold air into the oven, and wherein said hot and cold air supply means are both responsive to the variable flow control means so that introduction of hot and cold air into the oven is balanced to maintain oven temperature constant.

19. The system of claim 18 containing means for measuring variations in the flow rate of said exit end air leakage and means, responsive to measured variations in said leakage, for adjusting the hot and cold air introduced into the oven to thereby control exit end air leakage at a predetermined level independent of the flow rate of air exhausted from the oven.

20. The system of claim 19 wherein the means for measuring the amount of exit end air leakage comprises a temperature sensing means located within an independent mixing chamber disposed in the path of the leakage air, said chamber containing means for introducing a known amount of mixing air at known temperature so that variations in the flow rate of leakage air through said chamber effects a variation in the temperature of air in the mixing chamber which is thereby measured by the temperature sensing means located therein.

21. In an elongated oven having openings at both ends for the introduction and removal of substantially flat sheet material conveyed therethrough, a hot air supply system for introducing hot air into said oven and an exhaust system for exhausting hot air therefrom, a sealing system for maintaining the amount of room air drawn by the exhaust system into said oven at a predetermined level, comprising, in combination, a seal chamber located adjacent an end of the oven, an air supply system for forcing air into said seal chamber through curtain air jets located within said chamber and disposed on opposite sides of the sheet material and extending laterally thereacross, said air jets containing inclined discharge openings to provide, both above and below said sheet, substantially identical curtain-like air streams directed toward said sheet in the direction opposite to the travel thereof, an exhaust means opening through the top and bottom of said chamber for exhausting from said chamber air forced therein through said jet means, and means for regulating the amount of air forced through said jets to provide control of leakage into the oven.

22. The combination of claim 21 wherein the seal chamber includes second curtain air jets for providing curtain-like air streams directed toward said sheet but in the direction of travel thereof, or perpendicular to the sheet and means for regulating the amount of air forced through said jets to thereby provide control of inlet air leakage into said oven at the predetermined level.

23. In an oven for the continuous thermal treatment of substantially flat sheet material including a principal sheet material heating area, a hot air supply system for introducing hot air into said oven to provide heat therefor and an oven exhaust system for removal of air from the oven, a convection heating system comprising, in combination, air delivery means disposed on either side of the sheet material and including an array of apertured headers which separate the oven into longitudinal exhaust flow regions adjacent the top and bottom of the oven and convection working regions adjacent the top and bottom of the sheet material and substantially coextensive therewith, and a recirculating air supply system for supplying hot air to the apertured headers, the apertures of said headers being positioned to face said sheet material and being sized so that hot air delivered therethrough enters the working region in the direction substantially vertical to the sheet and at a high velocity to thereby achieve a high convection heat transfer coefficient and the array of the apertured headers being sufficiently open so that substantial longitudinal or lateral flow of recirculating air after impingement with said sheet is avoided in said working regions.

24. The combination of claim 23 wherein the air supply system for the headers includes means for withdrawing air from the oven and recirculating the air withdrawn back into the oven through the delivery headers.

25. The combination of claim 24 wherein the open area of the array is at least 60% of the projected area of the array.

26. The oven of claim 25 containing means for adjusting the velocity of the substantially vertically impinging air to thereby permit control of the convection heat transfer coefficient.

27. In an oven system for baking liquid based coatings on sheet material, the combination comprising, an oven through which said material is conveyed and defining an elongated housing having a principal sheet material heating area wherein coating liquid is first evaporated and the coating then baked, an inlet opening for the introduction of coated sheet material and an exit opening for the removal thereof, a hot air supply system and hot air supply means communicating therewith and opening into the heating area of said oven to thereby provide substantially all of the heat requirements thereof, and an oven exhaust system for removing air and evaporated liquid from the oven, said oven exhaust system containing duct means opening into said oven at a location near the inlet opening thereof so that substantially all of the hot air introduced into said oven is swept through the oven in a direction countercurrent to sheet travel.

28. The combination of claim 27 in which said oven contains means interposed between the inlet opening thereof and the exhaust duct means for controlling, at a predetermined level, the leakage of ambient air from the inlet opening into said exhaust system.

* * * * *